US011382382B2

(12) United States Patent
Oden et al.

(10) Patent No.: US 11,382,382 B2
(45) Date of Patent: Jul. 12, 2022

(54) ADJUSTABLE FOOTWEAR

(71) Applicant: Pandere Shoes, Inc., Anchorage, AK (US)

(72) Inventors: Laura Oden, Anchorage, AK (US); Ayla Rogers, Anchorage, AK (US); Celia MacLeod, Anchorage, AK (US); Tuan Le, Portland, OR (US); Jessica Nyqvist, Bordeaux (FR)

(73) Assignee: Pandere Shoes, Inc., Anchorage, AK (US)

( * ) Notice: Subject to any disclaimer, the term of this patent is extended or adjusted under 35 U.S.C. 154(b) by 18 days.

(21) Appl. No.: 16/367,928

(22) Filed: Mar. 28, 2019

(65) Prior Publication Data

US 2019/0297988 A1 Oct. 3, 2019

Related U.S. Application Data

(60) Provisional application No. 62/756,111, filed on Nov. 6, 2018, provisional application No. 62/650,355, filed on Mar. 30, 2018.

(51) Int. Cl.
*A43B 3/26* (2006.01)
*A43B 23/02* (2006.01)
(Continued)

(52) U.S. Cl.
CPC ..... *A43B 3/26* (2013.01); *A43B 3/242* (2013.01); *A43B 3/244* (2013.01); *A43B 23/027* (2013.01); *A43B 23/0295* (2013.01); *A43C 1/02* (2013.01)

(58) Field of Classification Search
CPC .. A43B 3/26; A43B 3/24; A43B 3/242; A43B 3/244; A43B 3/246; A43B 3/248;
(Continued)

(56) References Cited

U.S. PATENT DOCUMENTS 2,110,839 A * 3/1938 Ferriot ..... A43B 3/124 36/11.5
2,169,337 A * 8/1939 Davis ..... A43B 3/124 36/11.5
(Continued)

FOREIGN PATENT DOCUMENTS

WO WO 2007/038293 A2 4/2007
WO WO 2008/117270 A2 10/2008
WO WO 2012/067319 A1 5/2012

OTHER PUBLICATIONS

International Search Report and Written Opinion for International Application No. PCT/US2019/024614, dated Jul. 12, 2019.
(Continued)

*Primary Examiner* — F Griffin Hall
(74) *Attorney, Agent, or Firm* — Wolf, Greenfield & Sacks, P.C.

(57) ABSTRACT

An adjustable shoe includes an adjustable upper with independent components which can be adjusted longitudinally, laterally, and vertically to accommodate foot size variations including swollen or asymmetrical feet. In some embodiments, an adjustable upper includes at least one connecting member which may be arranged to selectively adjust at least one of an independent toe portion, side panel, and heel portion.

20 Claims, 36 Drawing Sheets

(51) Int. Cl.
*A43C 1/02* (2006.01)
*A43B 3/24* (2006.01)

(58) Field of Classification Search
CPC .. A43B 3/10; A43B 3/12; A43B 3/122; A43B 3/126; A43B 23/04; A43B 23/042; A43B 23/045; A43B 23/047; A43B 23/027; A43B 23/0295; A43C 1/02; A43C 1/003; A43C 1/006; A43C 1/06
USPC ..... 36/97, 100, 101
See application file for complete search history.

(56) References Cited

U.S. PATENT DOCUMENTS 2,438,711 A 3/1948 Leach et al.
2,526,940 A * 10/1950 Fello ..... A43B 3/122 36/11.5
2,551,723 A 5/1951 Camera
6,256,906 B1 * 7/2001 Matis ..... A43B 3/126 36/11.5
7,631,440 B2 * 12/2009 Keen ..... A43B 1/14 36/50.1
8,020,319 B1 9/2011 Mohaupt
2005/0268487 A1 * 12/2005 Ellis, III ..... A43B 13/14 36/25 R
2007/0011910 A1 * 1/2007 Keen ..... A43B 7/142 36/50.1
2015/0089839 A1 4/2015 James et al.
2017/0360144 A1 * 12/2017 Lee ..... A43B 3/26

OTHER PUBLICATIONS

[No Author Listed] The Shoe That Grows. Because International. https://becauseinternational.org/the-shoe-that-grows, last accessed Jul. 30, 2019, 8 pages.
International Preliminary Report on Patentability for International Application No. PCT/US2019/024614, dated Oct. 15, 2020.
PCT/US2019/024614, Jul. 12, 2019, International Search Report and Written Opinion.

* cited by examiner 100
102
104
106
108
110
112
114
116
118
120
122

ADJUSTABLE FOOTWEAR

RELATED APPLICATIONS

This Application claims the benefit under 35 U.S.C. § 119(e) of U.S. Provisional Application No. 62/650,355, filed Mar. 30, 2018, entitled "ADJUSTABLE FOOTWEAR" and U.S. Provisional Application No. 62/756,111, filed Nov. 6, 2018, entitled "ADJUSTABLE FOOTWEAR". The entire contents of these applications are incorporated herein by reference in their entireties.

FIELD

Disclosed embodiments are related to footwear with adjustable portions to accommodate feet of different sizes and shapes.

BACKGROUND

Traditionally, footwear is manufactured and sold as symmetrical same-size pairs of shoes. Typically, this footwear generally includes a substantially rigid sole and upper, such that the footwear may be worn comfortably if the shoes are correctly sized for a person. Conventional footwear generally has some adjustability or securement element, including laces, straps, etc. which allow a wearer to secure the correctly sized shoe to a foot. However, traditional footwear has a substantially fixed height, width, and length which aren't independently adjustable to accommodate variations in foot size.

SUMMARY

According to one embodiment, an adjustable footwear article includes a sole having a lower tread surface, an upper footbed, and an outer periphery. The footwear article also includes an upper portion secured to said outer periphery of said sole and having a top panel that is only releasably or adjustably secured to said outer periphery of said sole. An entirety of said top panel is adjustable upwardly away from said upper footbed.

According to another embodiment, an adjustable footwear article includes a sole having a lower tread surface, an upper footbed, and an outer periphery. The footwear article also includes an upper portion secured to said outer periphery of said sole, said upper portion including: a forward panel portion having at least two expandable forward portions positioned on opposite sides of a longitudinal axis of the footwear article, a rearward panel portion at least two expandable rearward portions positioned on opposite sides of the longitudinal axis, and an upwardly-repositionable upper toe portion releasably secured to a lower toe portion that extends upwardly from said outer periphery of said sole at a forward end portion thereof.

According to yet another embodiment, an adjustable footwear article includes a sole having a lower tread surface, an upper footbed, and an outer periphery. The footwear article also includes an upper portion secured to said outer periphery of said sole, said upper portion including: a forward toe panel including an upwardly raisable tongue portion, left and right side panels extending upwardly from respective left and right sides of said outer periphery of said sole, and located generally behind said forward toe panel, and left and right forward cross-panels secured to said sole at respective opposite sides of said forward toe panel. Each of the left and right forward cross-panels include a respective distal end portion that is selectively securable at different locations along respective ones of said right and left side panels. The tongue portion is upwardly raisable when said distal end portions of said left and right forward cross-panels are detached from said right and left side panels. The left and right side panels are expandable laterally outwardly when their respective distal end portions are detached from said right and left side panels.

According to still yet another embodiment, an adjustable shoe includes a sole with a lower surface and an outer periphery and an adjustable upper secured to at least a portion of the outer periphery. The adjustable upper includes a toe portion constructed and arranged to expand vertically and longitudinally relative to the sole and a heel portion constructed and arranged to expand laterally and longitudinally relative to the sole. The toe portion and heel portion are independently expandable relative to one another.

According to still yet another embodiment, an adjustable shoe includes a sole with a lower surface and an outer periphery and an adjustable upper secured to at least a portion of the outer periphery. The adjustable upper includes at least one side panel constructed and arranged to expand laterally and vertically relative to the sole. The at least one side panel includes two separate attachment regions configured to secure the at least one side panel to the outer periphery. The adjustable upper also includes a toe portion constructed and arranged to expand vertically and longitudinally relative to the sole and a stretch liner secured to the at least one side panel and extending between the two separate attachment regions. The at least one side panel and toe portion are independently expandable relative to one another.

According to still yet another embodiment, an adjustable shoe includes a sole including a lower surface, a recess, and an outer periphery and an adjustable upper secured to at least a portion of the outer periphery, the adjustable upper expandable vertically, laterally, and longitudinally. The adjustable shoe also includes a removable footbed. An uppermost portion of the outer periphery is aligned with an uppermost portion of the removable footbed.

According to still yet another embodiment, an adjustable shoe includes a sole including a lower surface and an outer periphery and an adjustable upper secured to at least a portion of the outer periphery. The adjustable upper is expandable vertically, laterally, and longitudinally and is constructed and arranged to expand by up to 1.5 US shoe sizes.

According to still yet another embodiment, an adjustable shoe includes a sole including a lower surface and an outer periphery and an adjustable upper secured to at least a portion of the outer periphery. The adjustable upper is expandable in at least two directions selected from the group of vertical, lateral, and longitudinal and has a ball region expandability coefficient between or equal to 8% and 12%.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figures 1A, 1B:
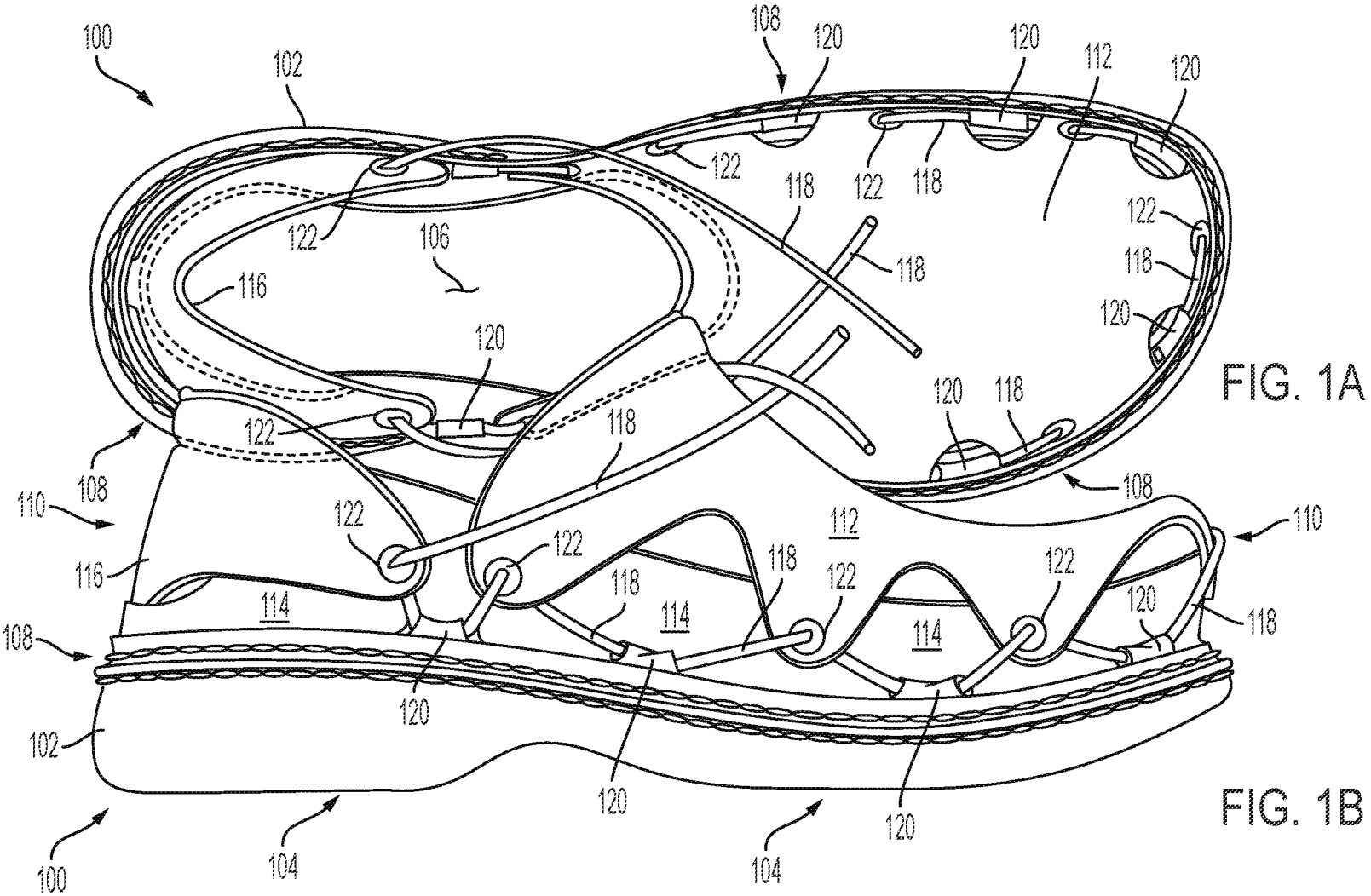
FIGS. 1A and 1B are partial-top and side elevation views, respectively, of one embodiment of an adjustable shoe.

Footwear is traditionally manufactured and sold in symmetrical pairs. In many cases, people have asymmetrical and/or differently sized feet. Feet may have variations in length, width, or height permanently or as a part of a temporary condition. Various conditions may cause asymmetric size variations in feet, including foot or ankle surgery, bone spurs, bunions, hammer toe, or edemas caused by arthritis, diabetes, treatment of cancer, or other circulatory and vascular conditions. When size change of the feet occurs, either symmetric or asymmetric, people will commonly purchase additional pairs of shoes of different sizes. In the case of asymmetric swelling, a person may use one shoe from a differently sized pair or will purchase one pair of shoes that is large enough for the larger foot (i.e., swollen foot) and wear an oversized shoe on the unswollen foot. In certain cases, people may resort to a medical boot on the larger or more swollen foot, thereby creating an obvious asymmetrical appearance and potentially drawing undesired public attention to asymmetry and/or a medical condition.

In view of the above, the inventors have recognized the benefits of adjustable footwear which allows for length, width, and height adjustment of a shoe. More specifically, the inventors have recognized the benefits of adjustable footwear which allows for expansion of the toe portion, upper, and heel portion to accommodate temporary or permanent variations in foot size or shape.

According to one embodiment, an adjustable shoe includes an adjustable upper with a toe portion, side panel, and heel portion which can be adjusted inwardly or outwardly to accommodate size variations (e.g., swelling) in different regions of a wearer's foot. The adjustable shoe can have the adjustable components tightened or loosened in multiple directions to allow a wearer to accommodate temporary or chronic swelling or other foot shape variations. Once adjusted as desired, matching pairs of adjustable shoes or other footwear articles may be worn in such a way as to present a generally symmetrical appearance to an outside viewer. That is, the adjustable shoe may accommodate foot size variations without the need for differently sized shoe pairs or specialized medical footwear. The adjustable shoe may be readjusted as needed to accommodate various permanent or temporary foot conditions.

In some embodiments, an adjustable shoe includes an adjustable toe portion. The toe portion may be adjustable upwardly, lengthwise, or laterally relative to a sole or footbed of the shoe. Accordingly, the toe portion region may be adjusted to accommodate size variations or swelling at the front of the foot in three dimensions: height, width, and length. In certain embodiments, different portions of the toe portion region may have different adjustment directions. For example, a first region may be arranged for height adjustment, whereas a second region is arranged for height, length, and lateral adjustment. Accordingly, the first region may be constrained to accommodate variations in a single direction (i.e., height) of an adjacent first foot portion where the second region may be able to accommodate variations in all three directions (i.e., height, length, and width) of an adjacent second foot portion. Such an arrangement may allow the adjustable shoe to maintain additional support and protection for the foot in foot portions less likely to have size variations without compromising adjustability of the shoe in areas likely to accommodate said variations.

In some embodiments, an adjustable shoe includes an adjustable side panel. The side panel may be adjustable upwardly or laterally relative to a sole or footbed of the shoe. Accordingly, the side panel may be adjusted to accommodate width or height size variations in a midfoot region of a wearer's foot. In certain embodiments, the adjustable shoe may include two side panels formed as two independent walls separated by a longitudinal opening. According to this embodiment, as the walls are not directly connected, the walls may be adjusted laterally independent of the other. Thus, the side panel may accommodate different size variations that may occur on different sides of the midfoot region. In some embodiments, the side panel may include one or more sole attachment regions which connect the side panel to the sole of the shoe. The sole attachment regions may have a substantially short longitudinal length relative to the length of the sole such that the portion of the side panel attached to the sole is reduced. Such an arrangement may promote additional lateral adjustability without compromising structural support. Of course, the one or more sole attachment regions may have any suitable arrangement and length, as the present disclosure is not so limited.

In some embodiments, an adjustable shoe includes an adjustable heel portion. The adjustable heel portion may be adjustable laterally or longitudinally (i.e., lengthwise) relative to the sole or footbed of the shoe. Accordingly, the adjustable heel portion may accommodate length or width size variations in the heel or ankle region of a wearer's foot. The heel portion may include one or more regions which have different flexibility. For example, a region of the heel portion near the sole of the shoe may be stiffer than a region of the heel portion near the side panel. Accordingly, support for the foot may be provided while allowing for adjustability in areas prone to swelling or other foot size variations.

In some embodiments, an adjustable shoe with adjustable upper components including a toe portion, side panel, and heel portion may be independently (i.e. separated) from one another. For example, each of the adjustable shoe upper components may be attached to the sole or footbed separately, allowing each piece to move and be adjusted independently of the others. Accordingly, different portions of the shoe may be adjusted to accommodate different size variations in different areas of the foot. That is, a wearer can adjust a specific portion to improve the fit of the shoe without compromising the fit of other portions. In some embodiments, the toe portion, side panel, and heel portion may be connected by one or more connecting elements. The connecting elements may be laces, elastic bands, or any another suitable arrangement which allow the wearer to secure the shoe to the wearer's foot and adjust the shoe components relative to one another. In certain embodiments, the connecting elements may be releasably attachable between shoe components, such that the shoe components may be entirely separated for additional adjustability. According to this embodiment, the connecting elements may be secured with a knot, hook and loop fastener (e.g., Velcro), buttons, snaps, buckles, or any other suitable arrangement that allows for adjustable fastening. In some embodiments, the shoe components may be indirectly interconnected with stretch material (e.g., elastane, spandex, etc.) which allow the components to be expanded without reducing the volume of the shoe in another region.

In some embodiments, at least one of an adjustable toe portion, side panel, and heel may include one or more stretch portions. The stretch portions may be made of stretch material (e.g., elastane, spandex, etc.) which is distinct from the material for the toe portion, side panel, and heel. The one or more stretch portions may be positioned in areas of the shoe likely to accommodate foot size variations, especially in areas likely to accommodate temporary foot size variations due to swelling. For example, flexible portions may be beneficial around the upper forefoot, around the lower sides of the midfoot, or around the sides of the ankle. Of course, the stretch portions may be positioned at any suitable location, as the present disclosure is not so limited.

In some embodiments, an adjustable shoe may include a removable inset footbed. More specifically, the shoe may include a recessed cavity in the sole of the shoe to receive the footbed. Such an arrangement may have numerous benefits, including alignment of the bottom of the foot with the bottom of adjustable shoe components and support for custom orthotics. Without wishing to be bound by theory, alignment of the bottom of the foot and the bottom of the adjustable upper allows for adjustability of the upper without any interference from rigid components that may form the footbed or sole of the shoe. That is, there are no rigid shoe components that interfere with lateral, longitudinal, or vertical size variations of the foot. The recess in the sole of the adjustable shoe may provide support for foot orthoses (i.e., orthotics) which may be used in combination with the adjustable shoes to change the support provided for the wearer's foot. The orthotics may provide a substantially separate and independent function than the adjustable upper portions of the shoes. Due to the recess in the sole, the orthotic or conventional footbed may be received and held securely in the shoe, thereby improving comfort and function of the footbed. Of course, the sole and footbed may have any suitable arrangement to allow for adjustability and expansion of an adjustable upper, as the present disclosure is not so limited.

In some embodiments, an adjustable shoe upper including an adjustable toe portion, side panel, and heel may be composed of a strong, flexible material. For example, the upper may be made of canvas, leather, or any other suitable material that allows for adjustability. As discussed previously, the adjustable shoe may also include stretch materials in at least a portion of the adjustable upper, including, but not limited to, spandex, neoprene, elastane, latex, stretch fiber blends, or any other suitable stretch material. In some embodiments, the stretch material may be two-way stretch or four-way stretch depending on the position of the stretch material in the upper. Such an arrangement may allow for additional support or additional expansion for different areas of the foot. For example, it may be beneficial to have four-way stretch material in the toe portion area around the top of the foot to allow for additional expansion, while it may be beneficial to have two-way stretch material around the ankle to provide more ankle support. Of course, the stretch material may have any suitable stretch direction and be positioned in any suitable location in the adjustable upper, as the present disclosure is not so limited. In some embodiments, the sole of the shoe may be composed of rubber, polyurethane, leather, plastic, thermoplastic rubber, or any other suitable material with a desirable durability and flexibility for a given activity (e.g., walking, hiking, athletics, etc.).

In some embodiments, an adjustable shoe with an adjustable upper may allow for size expansion of the shoe, such that a shoe may effectively accommodate multiple nominal sizes of feet. For example, an adjustable upper may be expanded such that the overall length, width, and/or height of the foot containing volume corresponds to an increased nominal shoe size as measured in US shoe size, European shoe size, UK shoe size, Mondopoint, or any other suitable metric. Such an arrangement may be beneficial to accommodate permanent, chronic, or temporary foot size variations which may cause a nominal size change of the foot. In some embodiments, an adjustable upper may expand longitudinally and laterally to increase the nominal size of the adjustable shoe by up to 1.5 US shoe sizes.

Adjustable shoes as described herein may be beneficial for a wide variety of people. For example, those with medical conditions that may have frequent temporary swelling or size variations in their feet may wish to wear a single pair of shoes without personal modification or the need to buy multiple pairs. Similarly, those with differently sized feet or more permanent conditions like bunions or heel spurs may also want a single pair of shoes which adjust to the different shapes of their feet. Adjustable shoes may also be desirable for children, where a single pair of shoes may be worn for longer than a non-adjustable pair of shoes. Additionally, shoe wearers without significant foot size variations may also find the adjustable shoe more comfortable to wear than traditional footwear due to a more customized fit. Of course, adjustable shoes may be used for any desirable application, as the present disclosure is not so limited.

It should be appreciated that the flexibility of an upper of an adjustable shoe and any connecting elements will permit some limited relative movement of the panels when the shoe is secured to a foot. Accordingly, the terms "secure" or "secured", as used herein, are intended to be relative and do not necessarily refer to rigidly fixed positions unless specifically stated as such.

Figures 9A, 9B:
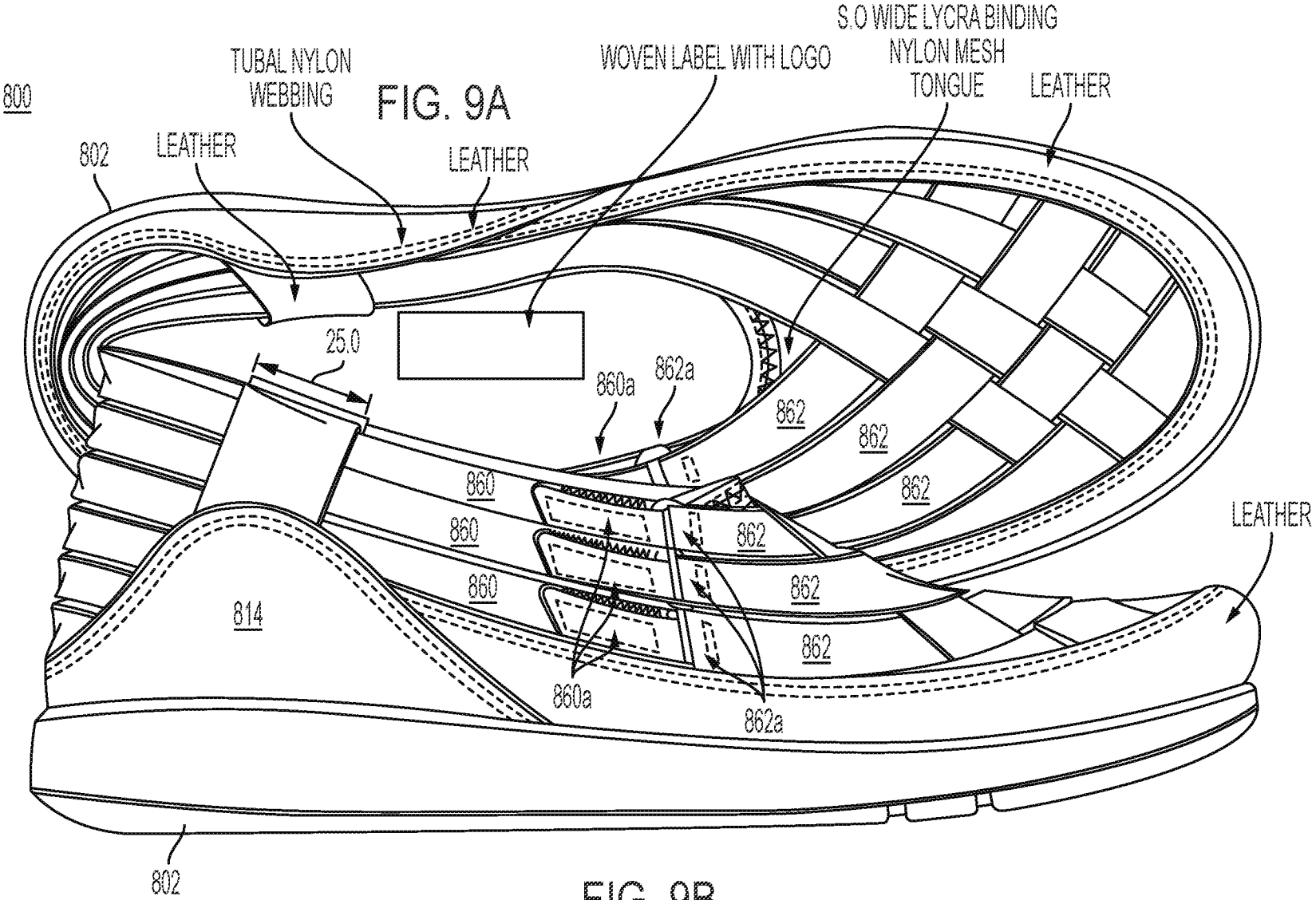
FIGS. 9A and 9B are partial-top and side elevation views, respectively, of yet another embodiment of an adjustable shoe with an upper portion partially made up of separate straps.
Figures 10A, 10B:
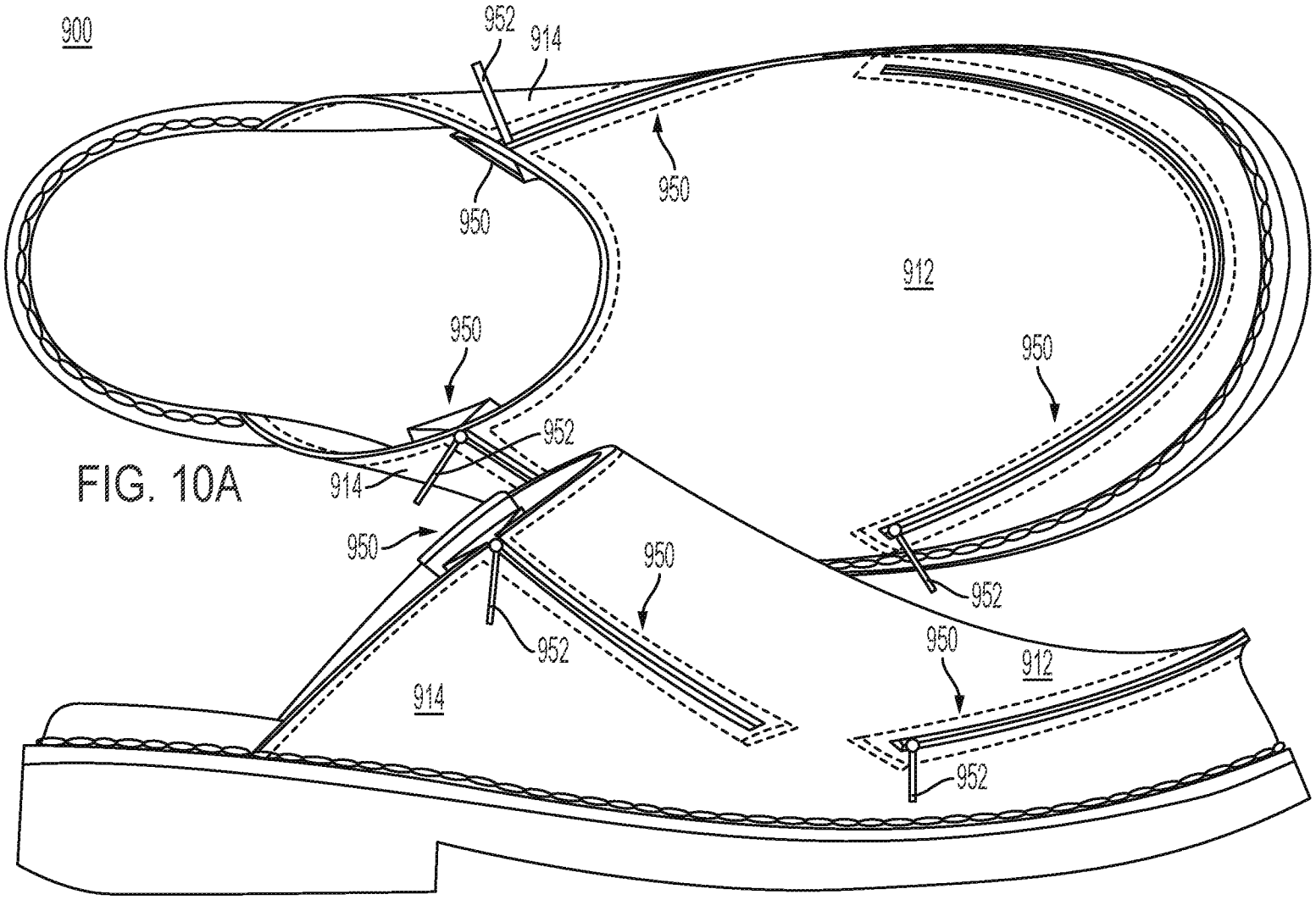
FIGS. 10A and 10B are partial-top and side elevation views, respectively, of yet another embodiment of an adjustable shoe with an open back and expandable sections shown in a closed configuration.
Figure 10C:
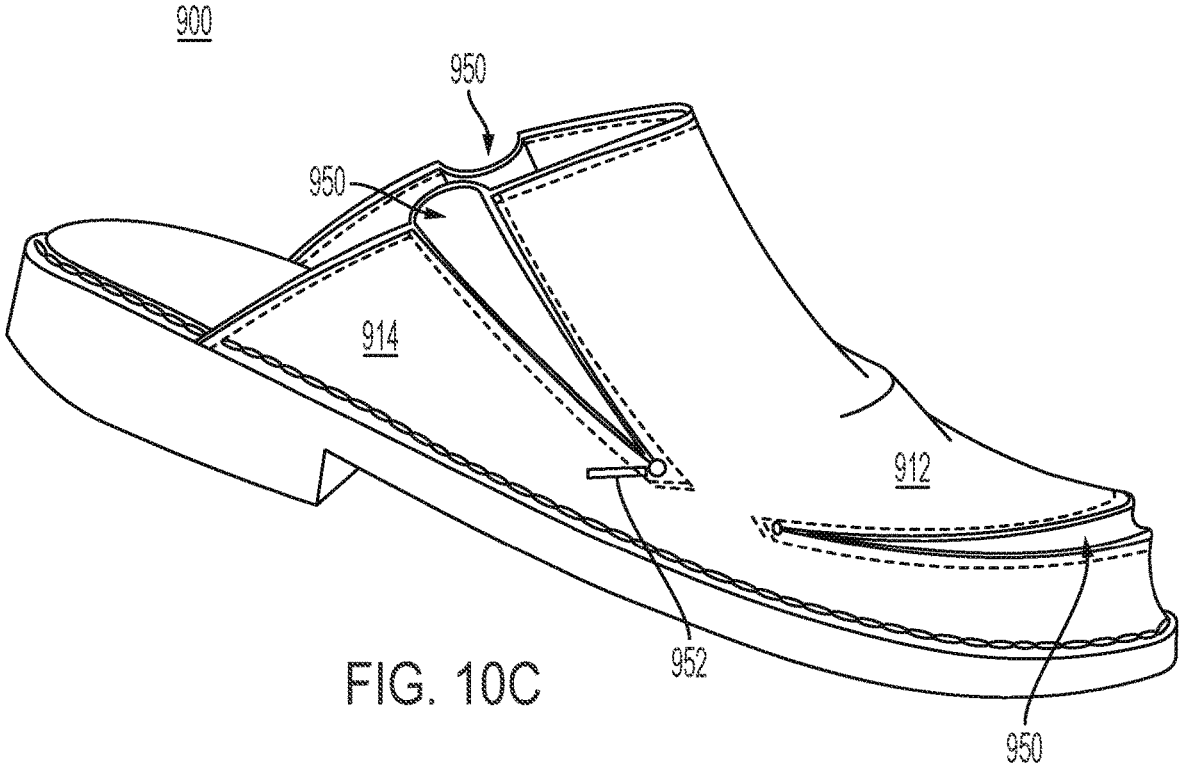
FIG. 10C is a perspective view of the adjustable shoe of FIGS. 10A and 10B, in which the expandable sections are shown in an open configuration.

Referring now to the drawings and the illustrative embodiments depicted therein, various types of adjustable shoes are disclosed, ranging from open sandals or sandal-like footwear (FIGS. 1A-2, 4A, 4B, 5A, 5B, 14A and 14B) to closed or substantially closed shoes (FIGS. 3A, 3B, 7A-9B, 11A-12C, 15A-15C, 16A and 16B), boots (FIGS. 13A-13C and 18), and clogs (FIGS. 10A-10C). Each of the adjustable shoes may have a substantially conventional sole, which may have an average thickness as shown in FIGS. 1A-2, 7A-18, or which may be thinner or thicker than the average thickness as shown in FIGS. 3A-6B, as desired. In each of the depicted embodiments, the adjustable shoes include an adjustable upper portion which is adjustable in at least one different areas (e.g., toe portion, side panel, heel portion), and in different directions in order to accommodate permanent or temporary size variations in feet (e.g., feet having temporarily or chronically swollen regions). Thus, matching pairs of adjustable shoes can be adjusted as desired to accommodate any feet asymmetries and size variations without a significant outward asymmetrical appearance.

Figure 2:
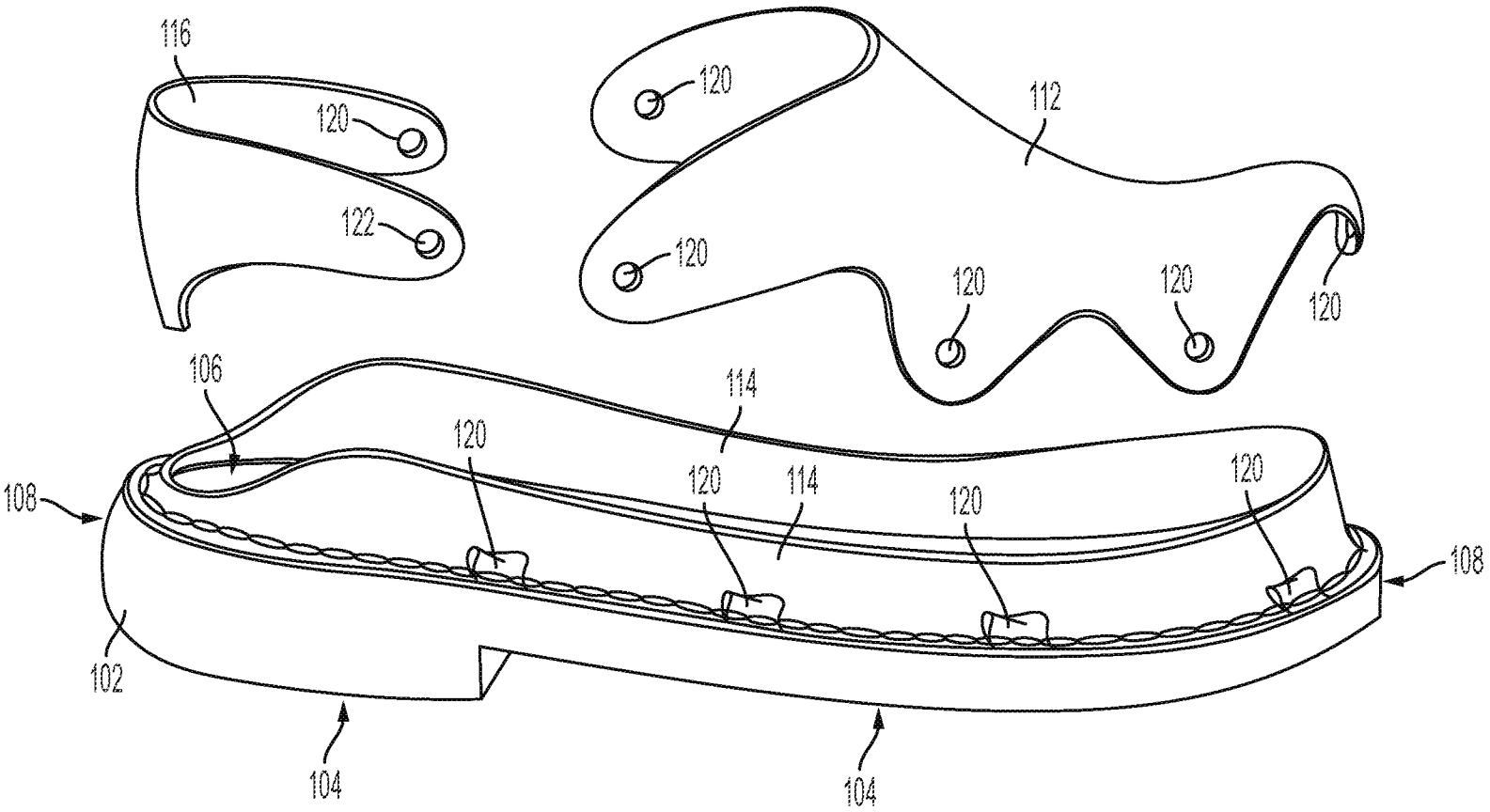
FIG. 2 is an exploded perspective view of a sole, toe panel, and heel portion of the adjustable shoe of FIGS. 1A and 1B.

FIGS. 1A-2 depict one embodiment of an adjustable shoe 100 which includes a conventional sole 102 with a lower tread surface 104, an upper footbed 106, and an outer periphery or perimeter region 108, plus an upper portion 110 that is secured to the sole's outer periphery 108. Upper portion 110 includes a top panel 112 that is adjustably secured to the outer periphery 108. The top panel 112 forms a side panel and toe portion of the shoe. As shown in FIG. 2, top panel 112 is not sewn or otherwise permanently attached to the sole 102, or to an upwardly-extending perimeter panel 114 of upper portion 110. Instead, the top panel 112 is arranged as a separate, independent piece that is adjustable upwardly away from the upper footbed 106. In addition, a separate heel portion 116 forming the heel portion is entirely separate and, together with top panel 112, is secured to sole 102 with a flexible elongate connecting element 118 such as a lace, cord, cable, or any other suitable arrangement. The connecting element 118 extends through sole-mounted loops 120 and openings 122 formed in top panel 112 and heel portion 116, and can be tied at a location above top panel 12 in order to secure top panel 112 and heel portion 116 relative to each other and relative to sole 102. Accordingly, by adjusting the tension of the connecting element 118, the top panel 112 and heel portion 116 may be adjusted or expanded relative to each out to accommodate foot size variations that may occur in the different regions of the foot. That is, the connecting element 118 may be loosened near particular openings 122 and tightened near other openings to substantially modify the shape of the interior volume of the upper portion 110 and accommodate foot size and shape variations.

As shown in FIG. 2, top panel 112 and heel portion 116 are entirely separate components that are only releasably or adjustably secured relative to sole 102, with adjustability provided by adjusting the effective length of connecting element 118, and with releasability provided by entirely removing connecting element 118 from the openings 112. In some embodiments, the upper panels may be further secured to the sole, either in a non-releasable manner (e.g., by sewing) or in a releasable manner (e.g., with hook and loop fasteners).

Figures 3A, 3B:
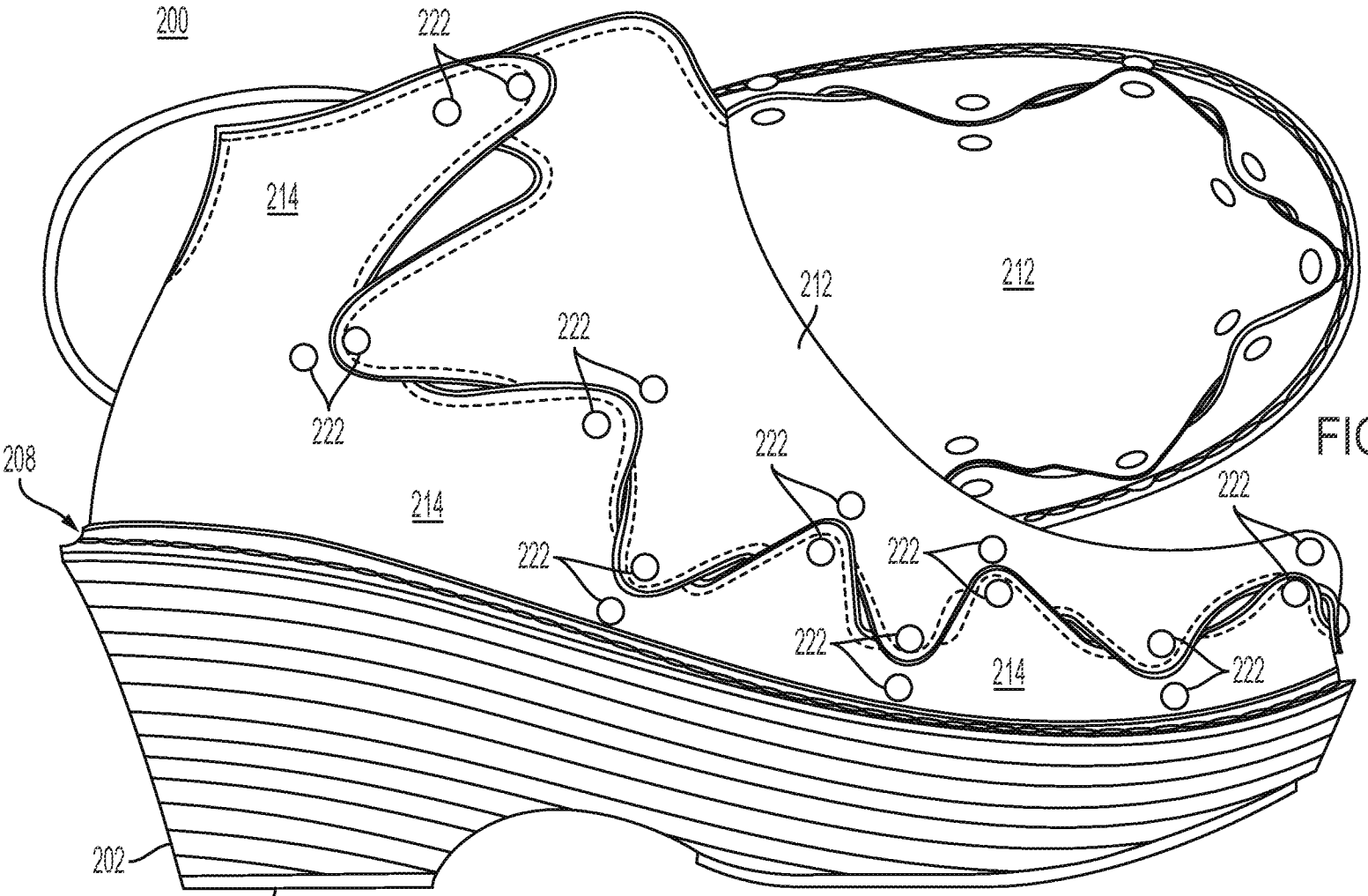
FIGS. 3A and 3B are partial-top and side elevation views, respectively, of another embodiment of an adjustable shoe with an enclosed heel portion.

As shown in FIGS. 3A and 3B, another embodiment of a shoe 200 includes an adjustable upper which enables the shoe to accommodate foot size variations as described above. The shoe 200 includes releasable a top panel 212 with openings 222. Shoe 200 includes a thick sole 202 that is substantially thicker than the sole of the shoe of FIGS. 1A-2. Shoe 200 further includes an upwardly-extending perimeter panel 214 that extends around an outer periphery 208 of sole 202, to thereby surround a rear or heel portion of a wearer's foot for additional support.

In the embodiment depicted in FIGS. 3A and 3B, top panel 212 is entirely separate from sole 202 and perimeter panel 214, and is secured to perimeter panel 214 via a lace (not shown) or other connecting element that extends through corresponding pairs of openings 222 found in perimeter panel 214 and top panel 212. Thus, by adjusting the tension and/or effective length of the lace or other flexible elongate securing member, the height of top panel 212 may be adjusted relative to sole 202 and perimeter panel 214. This adjustment permits the wearer to increase or decrease the volume of space available for the wearer's foot inside the shoe 200, and permits the wearer to selectively adjust the volume of space available for specific regions of the wearer's foot, by moving additional lace length in any regions of desired additional volume or space. For example, the wearer may slide additional lace length into the right side region of the shoe to permit lateral (i.e., rightward) expansion of the foot-receiving volume of the shoe 200, such as to accommodate a foot that is swollen along its right-hand side.

Figures 4A, 4B:
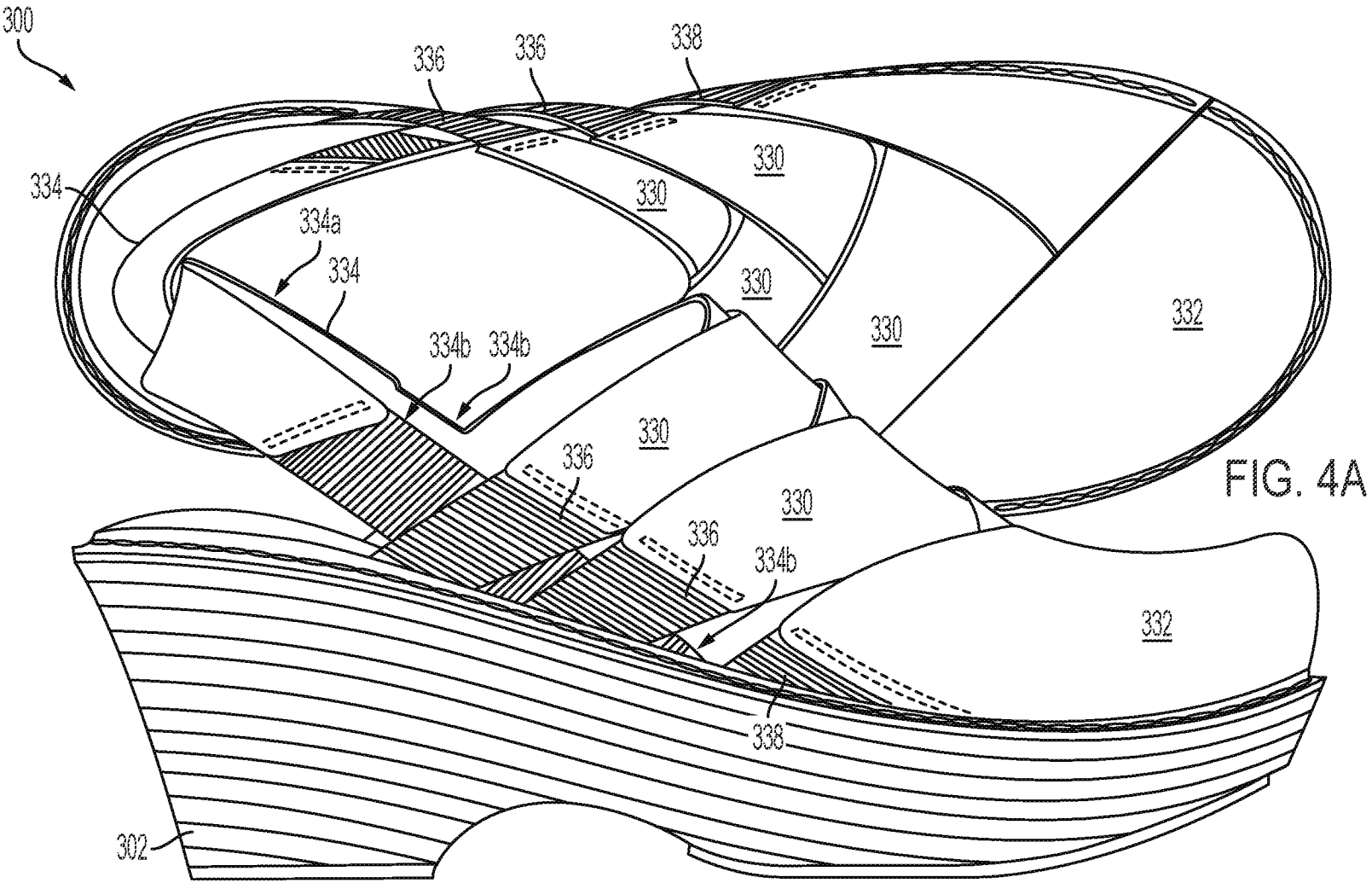
FIGS. 4A and 4B are partial-top and side elevation views, respectively, of yet another embodiment of an adjustable shoe with an upper portion partially made up of separate straps.

FIGS. 4A and 4B depict yet another embodiment of a shoe 300 for selective expandability of certain footwear regions achieved with the use of elastic materials including elastic strap portions. The shoe 300 includes at least four top straps 330 located rearward of a substantially fixed and closed toe panel 332, and with a heel strap 334 extending rearwardly from a midsection of the sole 302. Each of the top straps 330 has a proximal end portion secured to one side of the sole 302 via an attachment such as stitching or adhesive and a distal end portion 336 that is made up of elastic material and secured to an opposite side of the sole 302. The remainder of each top strap 330 may be made from a substantially non-stretch material, including, but not limited to, leather, canvas, or woven nylon. Heel strap 334 has a generally non-stretch midsection 334*a* and opposite end portions 334*b* made of elastic material. Thus, each of top straps 330 and heel strap 334 have at least one end portion made up of stretchable material where the strap attaches to sole 302. Optionally, a rearward end of closed toe panel 332 includes a stretchable panel or panel portion 338 where it attaches to sole 302, to permit additional expansion in that region. It will be appreciated that the stretchable portions of the straps and panels of the shoe 300 provide automatic expansion of areas in which a wearer's foot shape requires additional volume in an upward, lateral, or rearward direction.

Figures 5A, 5B:
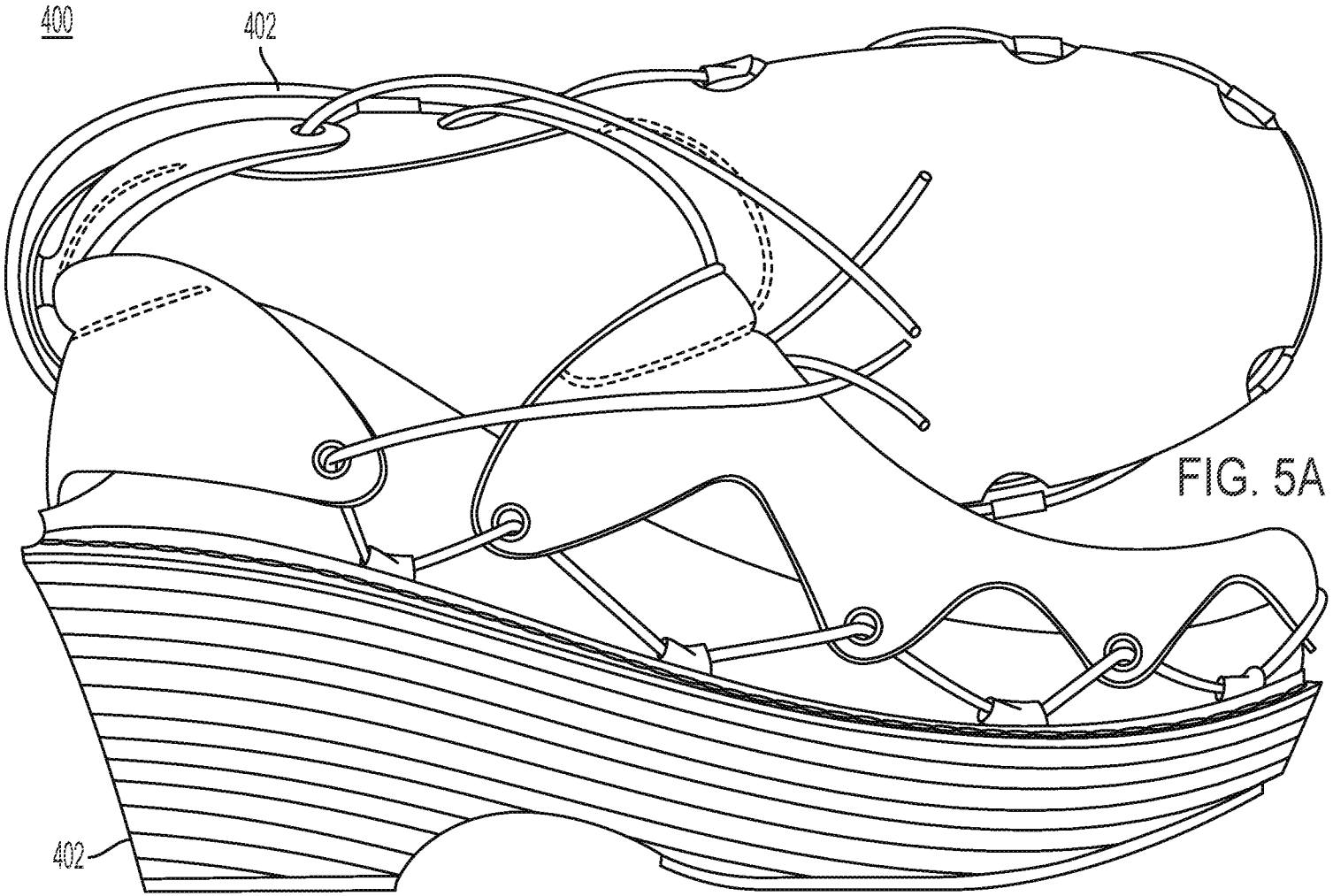
FIGS. 5A and 5B are partial-top and side elevation views, respectively, of yet another embodiment of an adjustable shoe with a similar upper portion to the shoe of FIGS. 1A and 1B.

FIGS. 5A and 5B depict yet another embodiment of a shoe 400 for selective expandability of an upper portion. The shoe 400 includes an upper similar to the embodiment depicted in FIGS. 1A-2, with an independent upper portion and heel portion which allow adjustability through selective effective length and tension adjustment of a flexible connecting element such as a lace. Compared to the embodiment of FIGS. 1A-2, the shoe 400 includes a thicker sole 402.

Figures 6A, 6B:
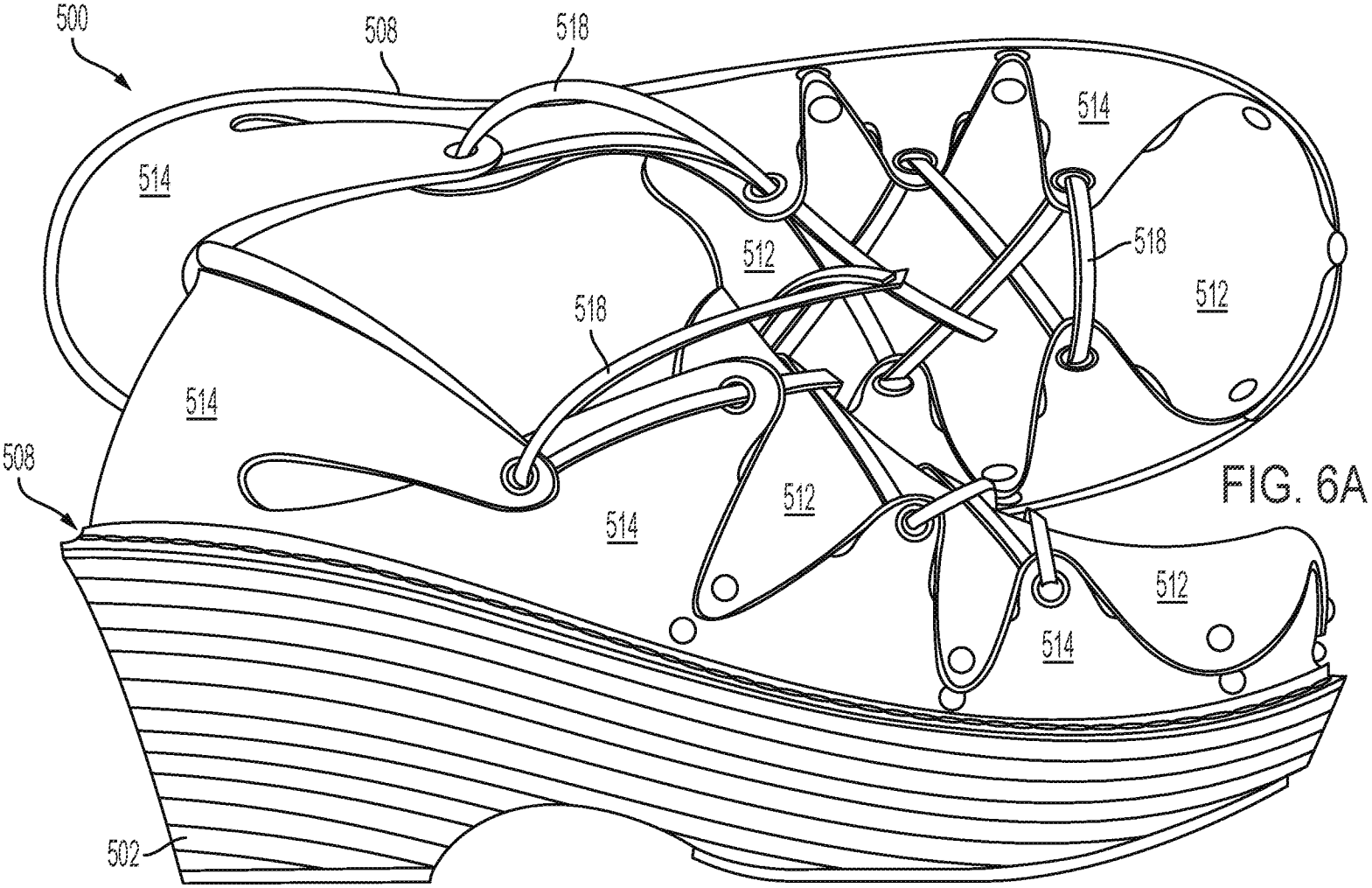
FIGS. 6A and 6B are partial-top and side elevation views, respectively, of yet another embodiment of an adjustable open shoe.

FIGS. 6A and 6B depict yet another embodiment of an adjustable shoe 500. The shoe 500 utilizes an upwardly-extending perimeter panel 514 that extends around an outer periphery 508 of sole 502, to thereby surround a rear or heel portion of a wearer's foot, rather than providing a separate heel portion in a similar manner to the embodiment depicted in FIGS. 3A and 3B. As shown in FIGS. 6A and 6B, upwardly-extending perimeter panel 514 partially overlaps a top panel 512 and is partially overlapped by the top panel 512, and utilizes a connecting element 518 depicted in this embodiment as a lace to secure the separate top panel 512 relative to perimeter panel 514. The relative length of the untied portion of connecting element 518 can be increased overall to provide additional volume for a wearer's foot, and can be lengthened in localized areas to permit regional expansion in a similar manner as described above.

Figures 7A, 7B:
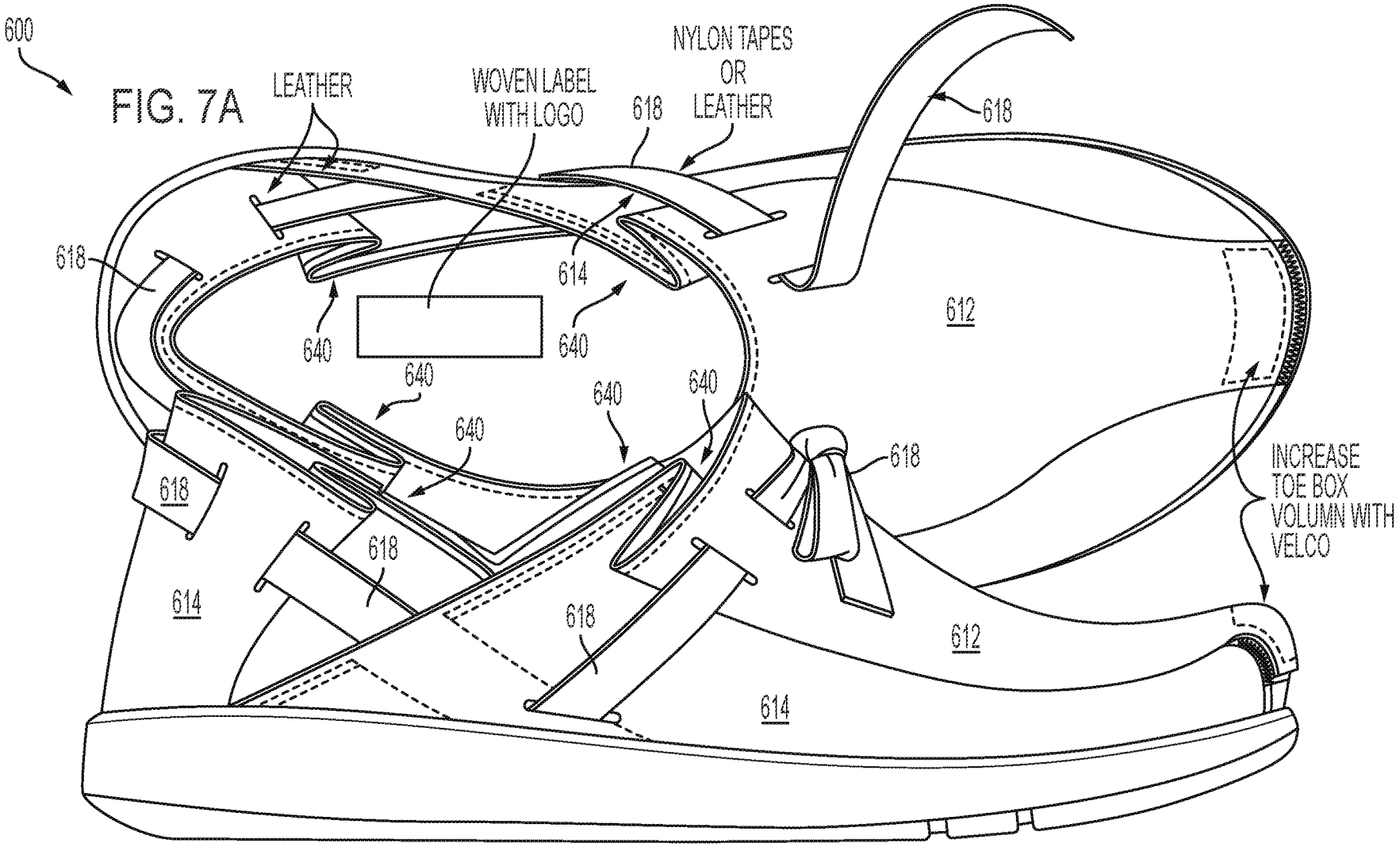
FIGS. 7A and 7B are partial-top and side elevation views, respectively, of yet another embodiment of an adjustable closed shoe.

FIGS. 7A and 7B depict yet another embodiment of an adjustable shoe 600. The adjustable shoe includes a top panel 612 and a perimeter panel 614 which form the side and heel portion of the shoe. The perimeter panel includes one or more expansion joints 640 positioned in various locations in the panels. The expansion joints may be utilized for general or localized expansion or retraction of the top panel 612 and/or perimeter panel 614. Shoes may also utilize expandable or length-adjustable portions to provide additional volume in localized areas. As shown in FIGS. 7A and 7B, the expansion joints may be arranged as Z-shaped folds. Accordingly, as additional expansion is required, the Z-shaped folds may unfurl to allow for additional length of panel material. Of course, any suitable arrangement for the expansion joints may be employed such that additional material is available for panel expansion. The adjustable shoe 600 also includes a connecting element 618 for securing the shoe to a wearer's foot, in addition to allowing the panels to be expanded by adjusting the effective length or tension of the connecting element. As shown in FIGS. 7A and 7B, the connecting element 618 may be arranged as a flexible strap or band.

Figures 8A, 8B:
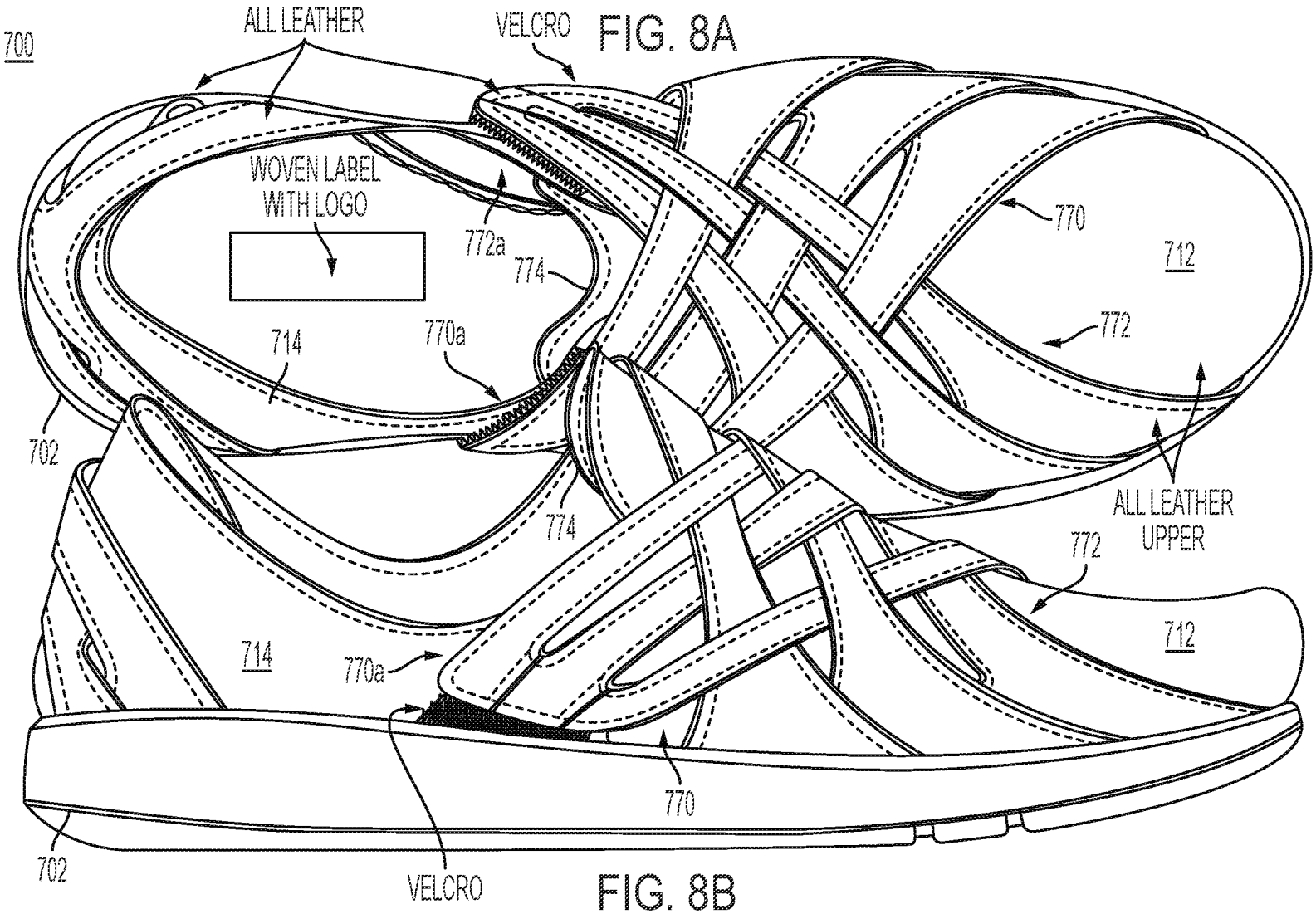
FIGS. 8A and 8B are partial-top and side elevation views, respectively, of yet another embodiment of an adjustable shoe.
Figures 15A, 15B:
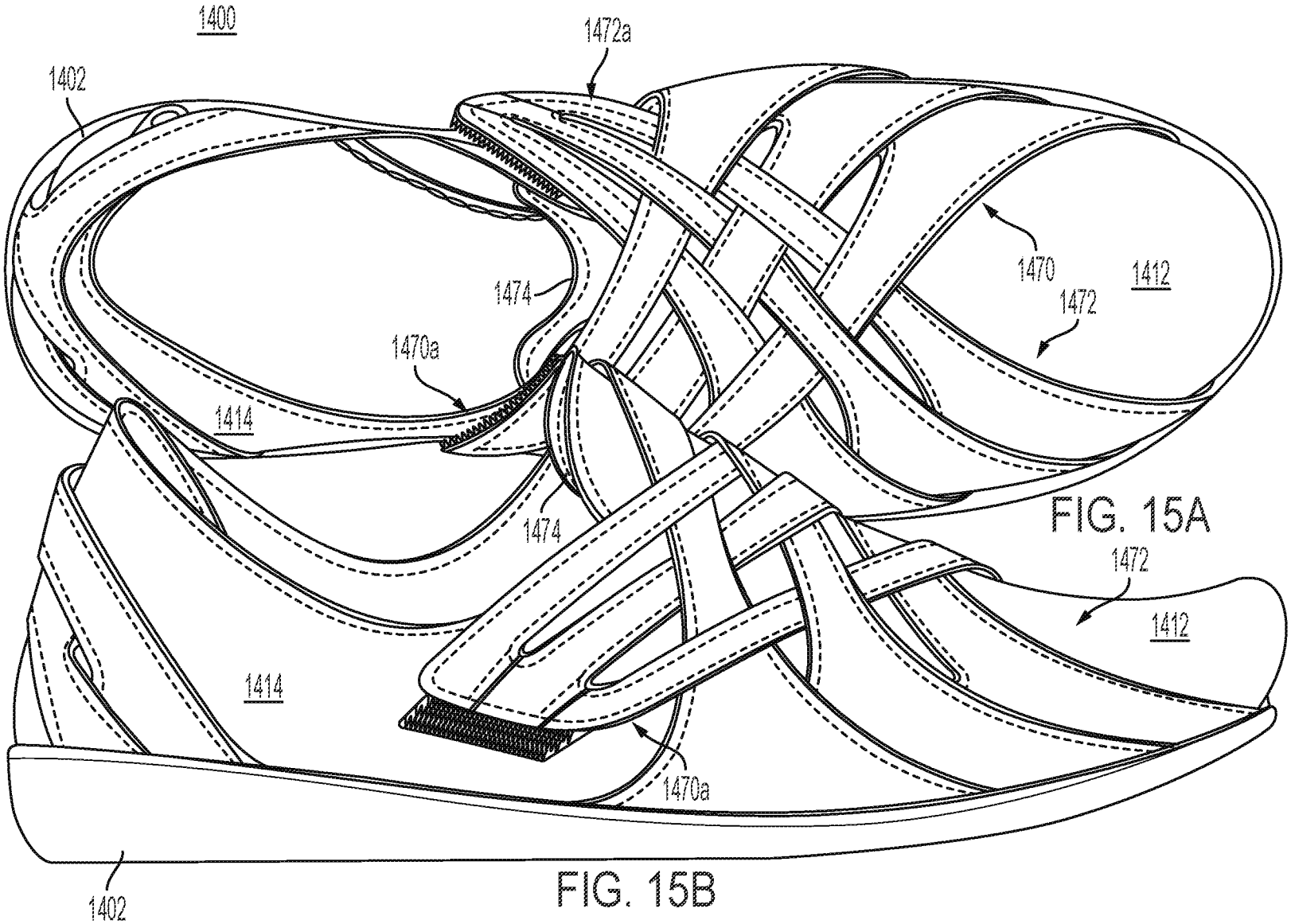
FIGS. 15A and 15B are partial-top and side elevation views, respectively, of yet another embodiment of an adjustable shoe similar to that of FIGS. 8A and 8B, with an upper portion including separate straps.
Figure 15C:
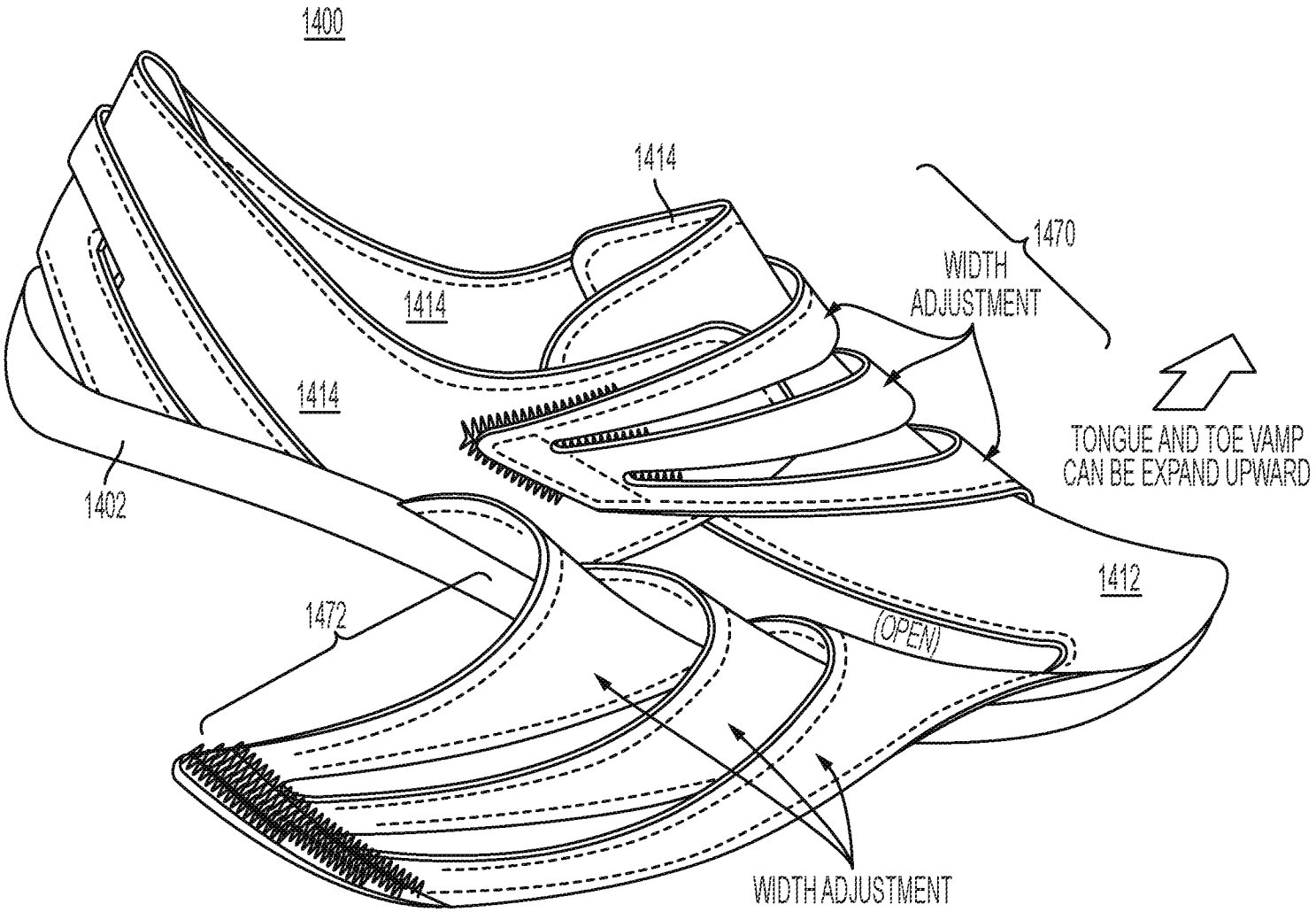
FIG. 15C is a perspective view of the adjustable shoe of FIGS. 15A and 15B, in which an adjustable multi-strap section is detached to facilitate upward expansion of a top panel.

FIGS. 8A and 8B depict yet another embodiment of an adjustable shoe 700. The adjustable shoe 700 includes a left forward cross-panel 770 and right forward cross-panel 772 each secured to the sole 702 at respective opposite sides of a forward toe panel 712. Each of the left and right forward cross-panels 770, 772 includes a distal end portion 770*a*, 772*a* that is selectively securable at different locations along side panels 714. An optional tongue portion 774 is associated with each forward toe panel 712 and is upwardly raisable when the distal end portions of the cross-panels are detached from the side panels 714. The left and right forward cross-panels 770, 772 are expandable laterally outwardly when their respective distal end portions 770*a*, 772*a* are detached from the side panels 714. The respective distal end portions 770*a*, 772*a* are selectively securable at different locations along the side panels 714 using hook and loop fasteners (e.g., Velcro) as shown or any other suitable releasable fastener. The left and right forward cross panels 770, 772 may be slidably interconnected, such that each panel may move independently relative to the other in at least one direction. Accordingly, the cross-panels 770, 772 may be adjusted independently to accommodate foot size variations. In other embodiments, such as the embodiment depicted in FIGS. 15A-15C, the cross-panels may overlay one another without any interconnection, such that the cross panels may be independently adjustable relative to one another in all directions. As shown in FIG. 15C, the toe panel 1412 may be connected to the sole near the front of the toe portion, with the tongue 1474 separated entirely from the sole to allow additional upward adjustability of the tongue and toe panel.

Figures 14A, 14B:
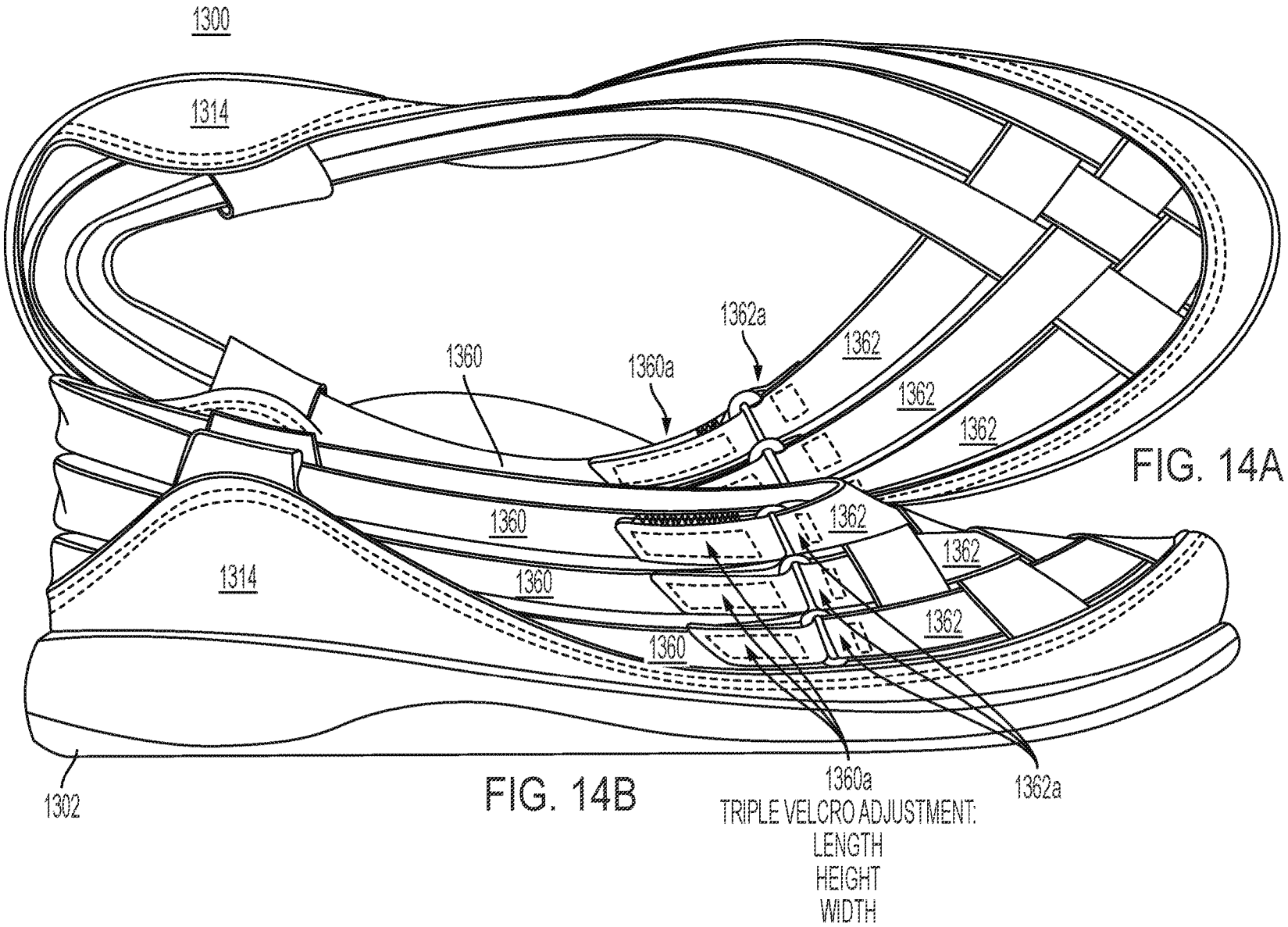
FIGS. 14A and 14B are partial-top and side elevation views, respectively, of yet another embodiment of an adjustable shoe similar to that of FIGS. 9A and 9B, with an upper portion including separate straps.

FIGS. 9A and 9B depict yet another embodiment of an adjustable shoe 800. The adjustable shoe includes a series of adjustable-length straps 860. As shown in FIG. 9B, the straps 860 are horizontal straps which are vertically stacked and coupled to respective forward straps 862 to provide lateral, longitudinal (i.e., lengthwise), and vertical adjustability. Each strap 860 terminates at a respective forward end portion 860*a* that is adjustably securable to itself at different positions corresponding to different lengths after looping through a rearward end portion 862*a* of the forward straps 862. As shown in FIGS. 9A and 9B, the uppermost horizontal strap 860 and the uppermost forward strap 862 cooperate to define the forward end portion of the upper foot opening for each shoe 800, such that that the longitudinal location of the uppermost forward strap 862 can be adjusted to accommodate large or swollen foot regions at different longitudinal locations along a wearer's foot. Additionally, such an arrangement allows adjustment of the toe portion via adjustment of the lower adjustable-length horizontal straps 860 and the corresponding forward straps 862. FIGS. 14A and 14B depict another embodiment of an adjustable shoe 1300 with a similar structure to the embodiment of FIGS. 9A and 9B. Compared to the embodiment of FIGS. 9A and 9B, the embodiment of FIGS. 14A-14B the perimeter panel 1314 is closer to the sole 1302, thereby allowing adjustment and expansions of the straps 1360 along a lower vertical position of the foot.

FIGS. 10A-10C depict yet another embodiment of an adjustable shoe 900. The adjustable shoe 900 includes a perimeter panel 914 and a top panel 912 each with a number of expansion joints 950. As shown in FIGS. 10A-10B, the expansion joints 950 are closed with a zipper 952 in a closed position such that the top panel 912 and perimeter panel 914 are not significantly expandable. As shown in FIG. 10C, the zipper 952 is in an open position with the expansions joints 950 open and expandable. Without wishing to be bound by theory, such an arrangement allows a wear to quickly and easily adjust the amount of expansion of the top and bottom panels. Similar to the embodiment depicted in FIGS. 7A and 7B, the expansion joint may be composed of folded, flexible material which unfurls to expand the perimeter and side panels when the zipper is opened. Expansion joints 950 may be formed from a substantially non-stretch material, such as the same or similar material as perimeter panels 914, and top panels 912 or a thinner and more flexible material for comfort. Optionally, the expansion joints 950 may be formed from stretchable material to provide added expansion in certain regions of the shoes as desired.

Figures 11A, 11B:
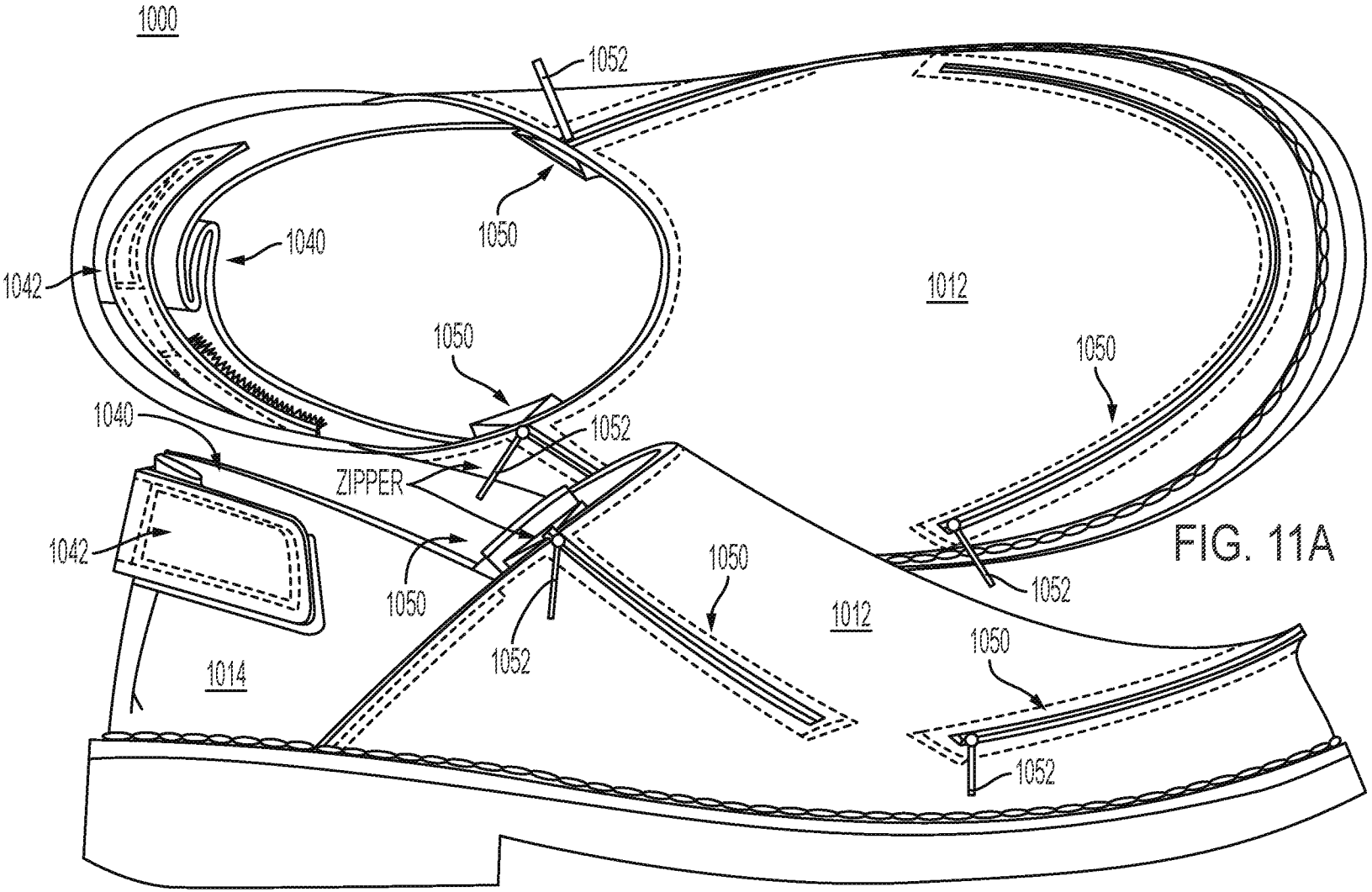
FIGS. 11A and 11B are partial-top and side elevation views, respectively, of yet another embodiment of an adjustable shoe with expandable sections shown in a closed configuration.
Figure 11C:
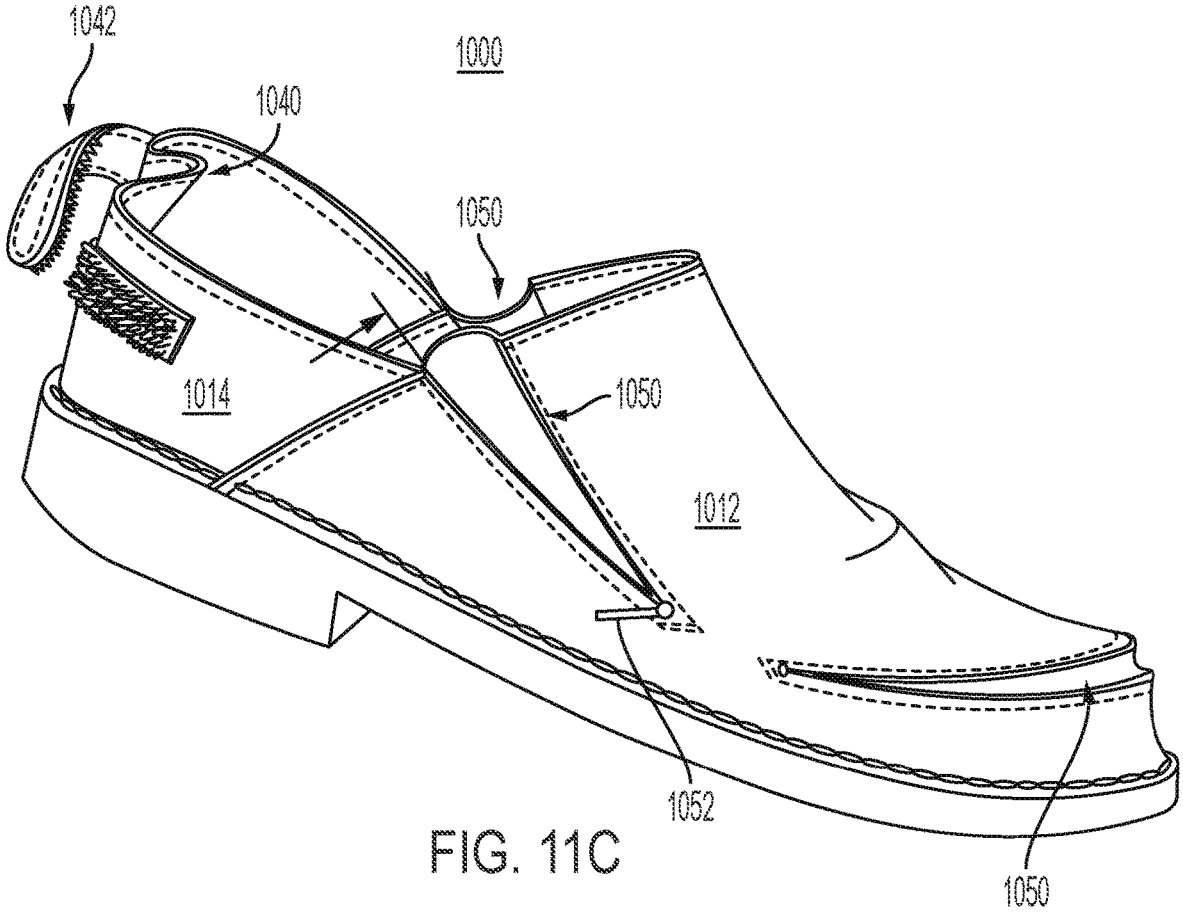
FIG. 11C is a perspective view of the adjustable shoe of FIGS. 11A and 11B, in which the expandable sections are shown in an open configuration.

FIGS. 11A-11C depict yet another embodiment of an adjustable shoe 1000. The adjustable shoe 1000 includes an expandable top panel 1012 and a perimeter panel 1014 including an expansion joint 1050 and a zipper 1052 similar to the embodiment of FIGS. 10A-10C as described above. Compared with the embodiment of FIGS. 10A-10C, the embodiment of FIGS. 11A and 11B includes a heel portion formed as part of the perimeter panel 1014 which includes a heel expansion joint 1040 and a heel strap 1042. The heel strap 1042 may have a proximal end secured to a first side of the heel portion and a distal end releasably attachable to a second side of the heel portion. As shown in FIGS. 11A and 11B, the heel strap is releasably attached to the second side with a hook and loop fastener (e.g., Velcro), thereby securing the expansion joint 1040 to substantially prevent expansion. The heel strap allows for adjustability and expansion of the perimeter panel 1014, especially the heel portion, to accommodate ankle swelling or any other longitudinal (i.e., lengthwise) swelling of the foot. As shown in FIG. 11C, the heel strap 1042 is released, thereby allowing expansion joint 1040 to expand through unfurling of folded material. Without wishing to be bound by theory, such an arrangement may allow the perimeter panel 1014 to expand outward past a boundary defined by a sole of the shoe, thereby effectively increasing the size to accommodate foot size variations.

Figures 12A, 12B:
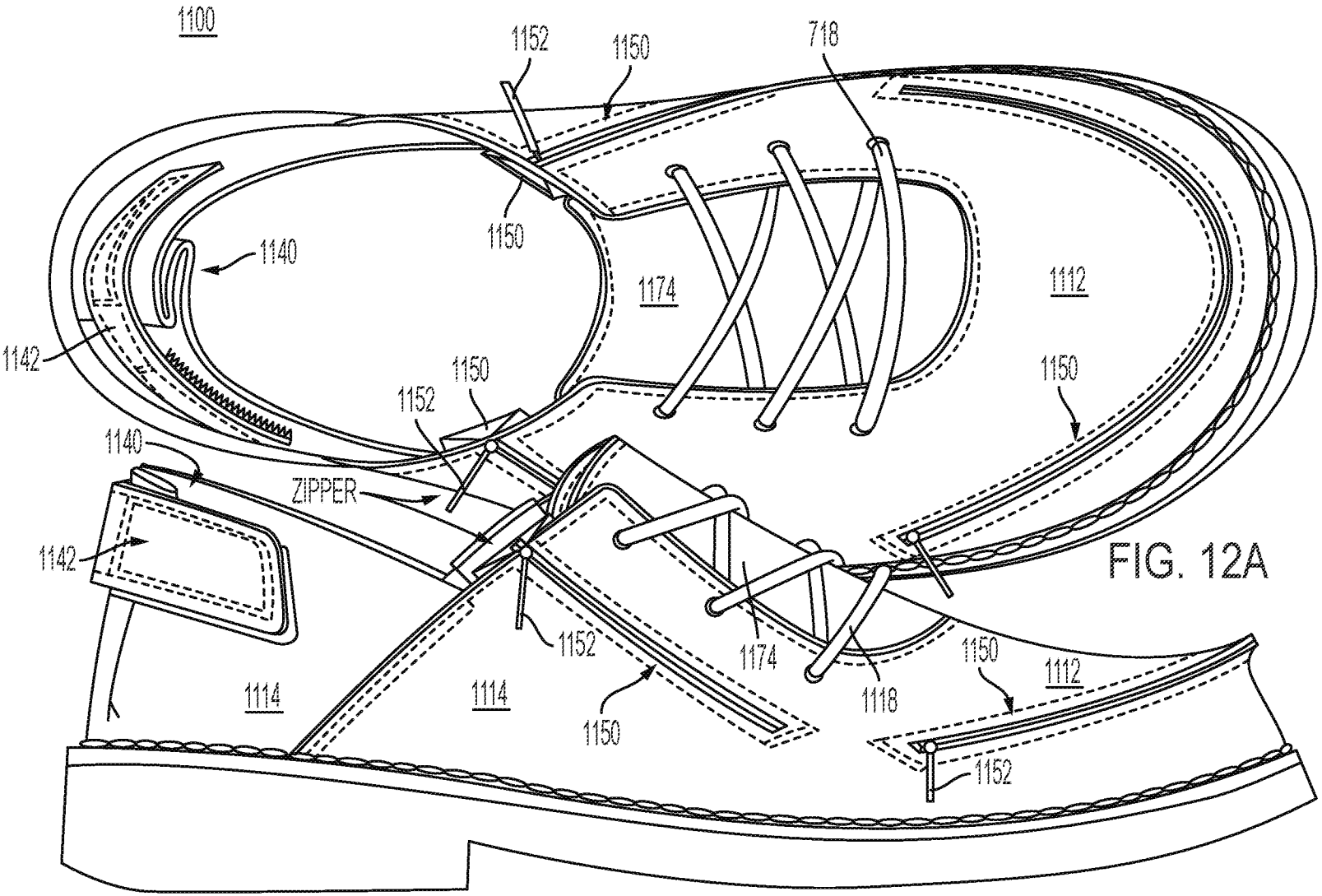
FIGS. 12A and 12B are partial-top and side elevation views, respectively, of yet another embodiment of an adjustable shoe similar to that of FIGS. 11A-11C and including a laced upper portion with expandable sections shown in a closed configuration.
Figure 12C:
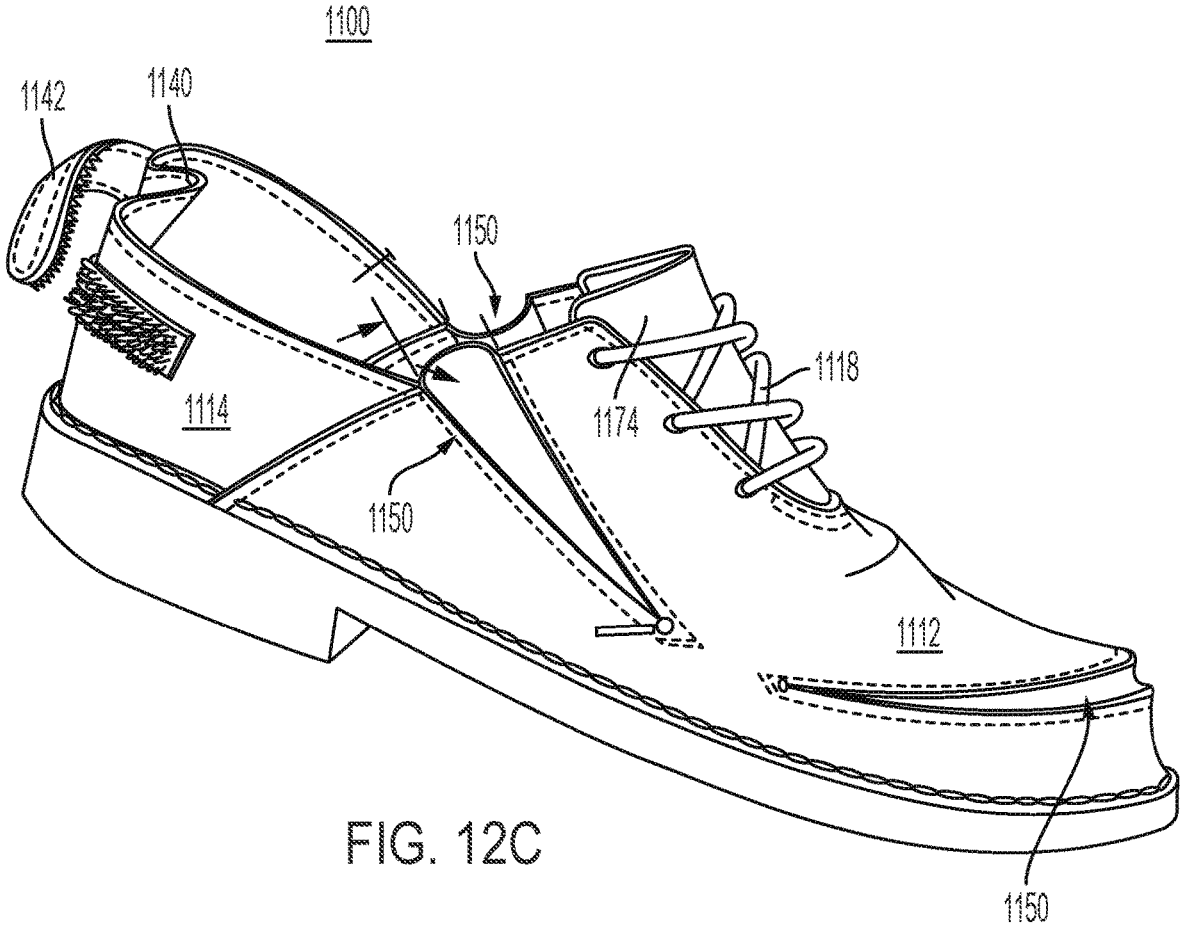
FIG. 12C is a perspective view of the adjustable shoe of FIGS. 12A and 12B, in which the expandable sections are shown in an open configuration.

FIGS. 12A-12C depict yet another embodiment of an adjustable shoe 1100. The adjustable shoe includes an expandable top panel 1112 and a perimeter panel 1114 including an expansion joint 1150, heel expansion joint 1140, zipper 1152, and heel strap 1142 similar to the embodiment of FIGS. 11A-11C as described above. Compared to the embodiment of FIGS. 11A-11C, the embodiment of FIGS. 12A-12C includes a tongue 1174 and a connecting element 1118 which adds additional adjustability to the top panel 1112. The tongue and connecting element allow the perimeter panel to be adjusts laterally outward and upward to accommodate width and height size variations in feet.

Figures 13A, 13B:
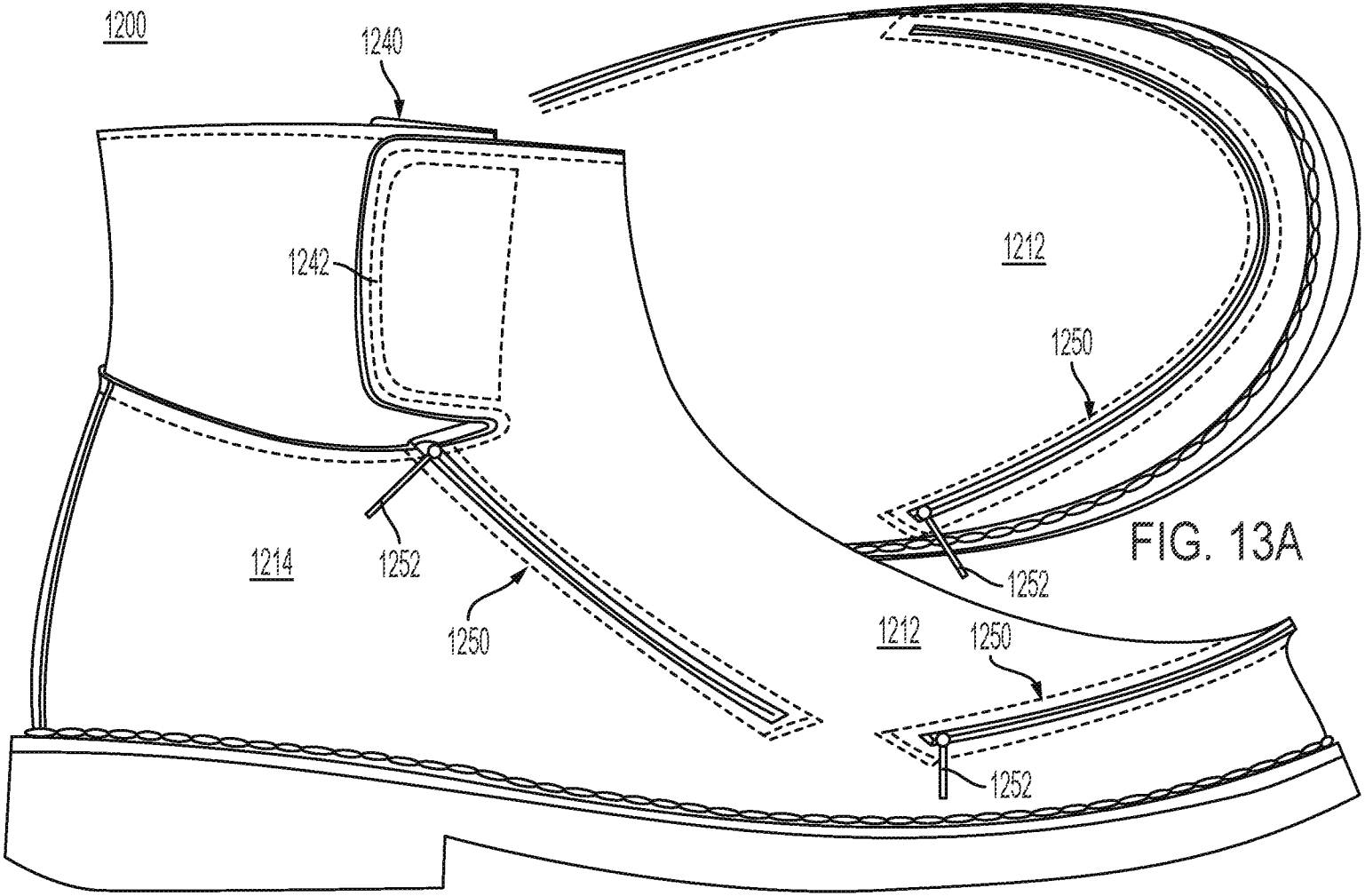
FIGS. 13A and 13B are partial-top and side elevation views, respectively, of yet another embodiment of an adjustable shoe with expandable sections shown in a closed configuration.
Figure 13C:
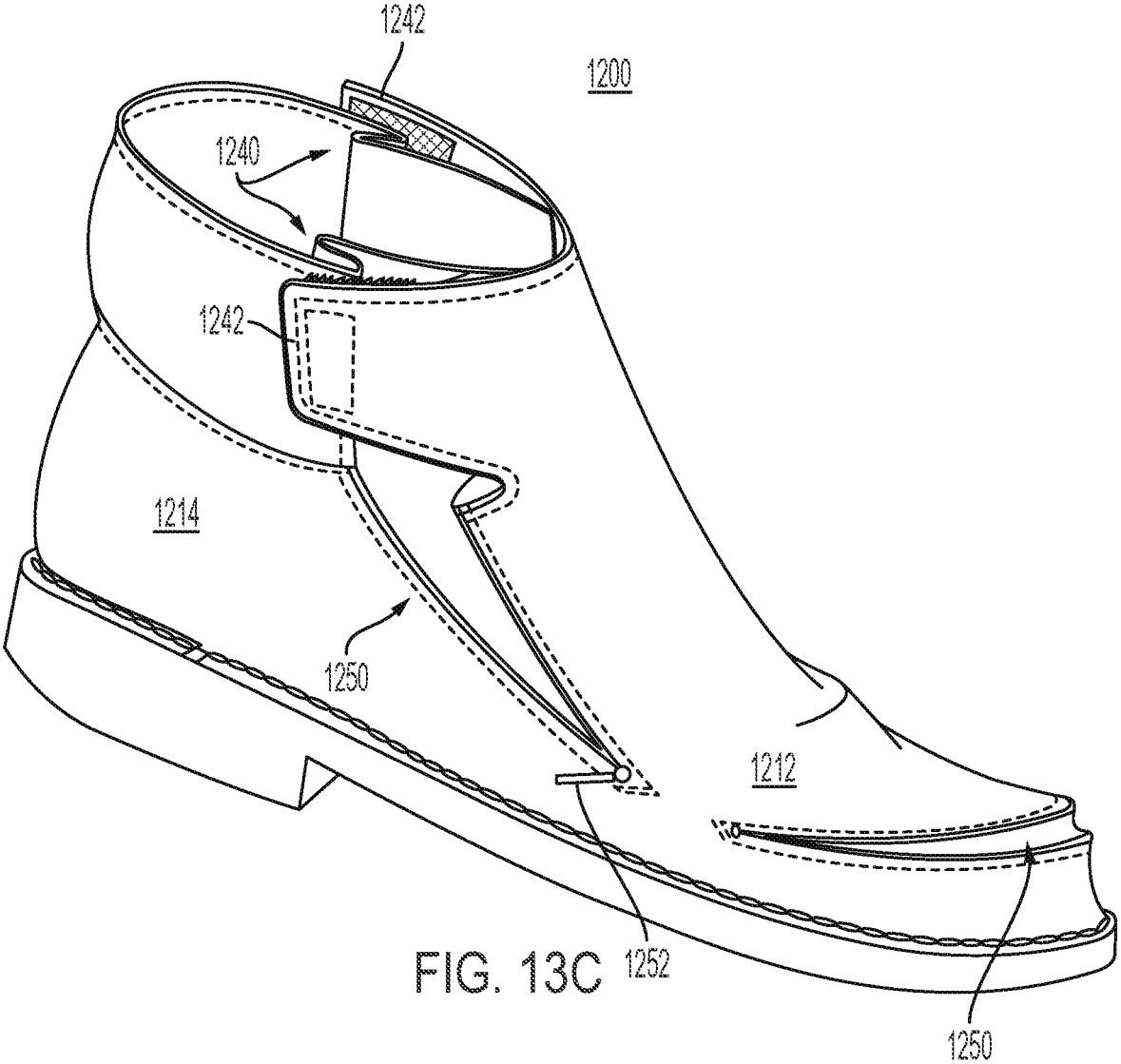
FIG. 13C is a perspective view of the adjustable shoe of FIGS. 13A and 13B, in which the expandable sections are shown in an open configuration.

FIGS. 13A-13C depict yet another embodiment of an adjustable shoe 1200. Similar to the embodiments of FIG. 11A-12C as described above, the shoe 1200 includes an adjustable top panel 1212 and perimeter panel 1214. Expansion joints 1250 are positioned between the top panel 1212 and the perimeter panel 1214 and are opened or closed by a zipper 1252 to selectively allow expansion in different regions of the shoe. As shown in FIGS. 13A-13C, the shoe 1200 includes an adjustable ankle region including ankle expansion joints 1240 and ankle straps 1242. The ankle expansion joints allow the ankle region to be adjusted laterally and longitudinally outward to accommodate any ankle size variations.

Figures 16A, 16B:
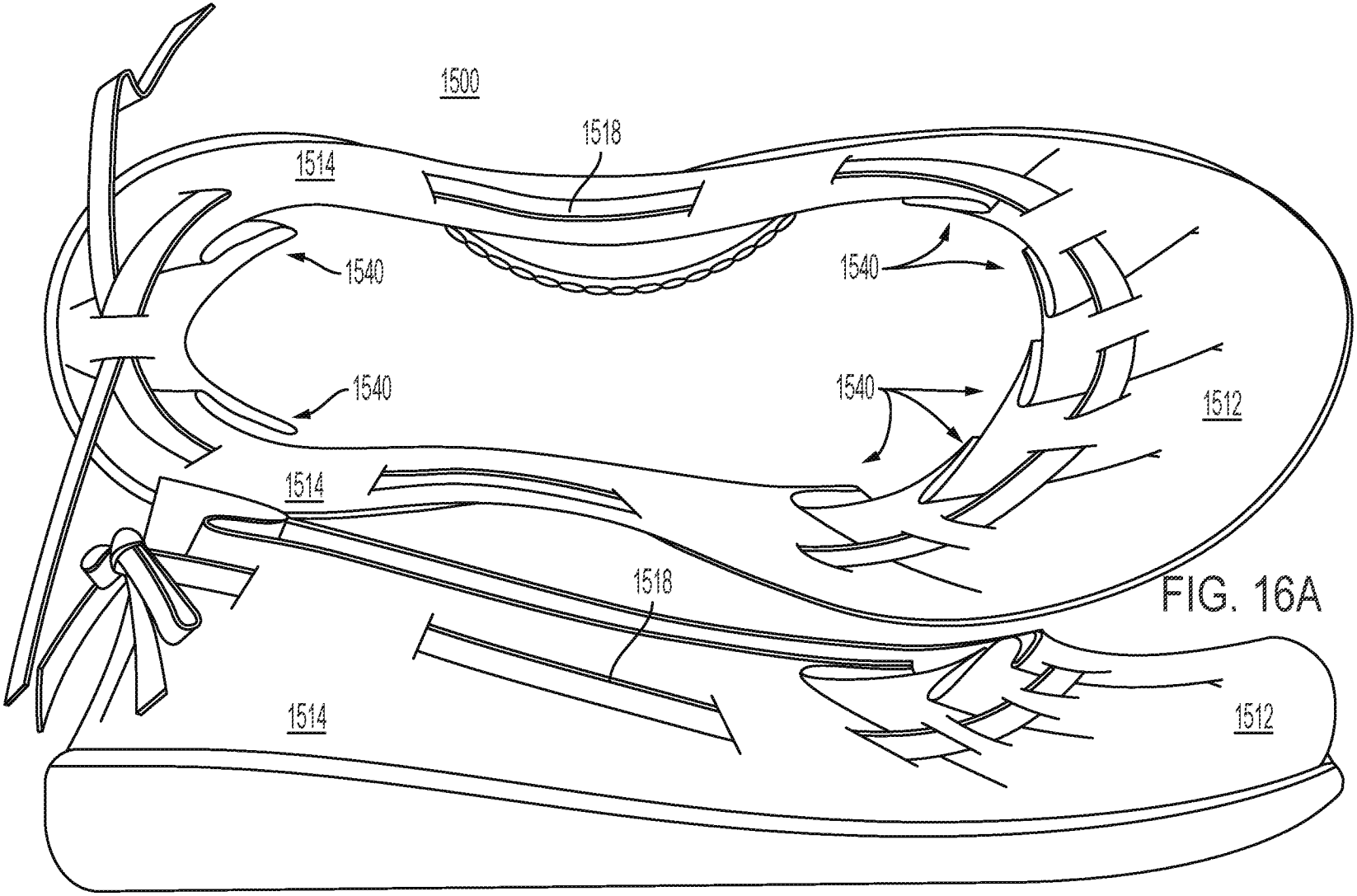
FIGS. 16A and 16B are top plan and side elevation views, respectively, of yet another embodiment of an adjustable shoe with a substantially continuous single upper panel.

FIGS. 16A and 16B depict yet another embodiment of an adjustable shoe 1500. The adjustable shoe 1500 includes a continuous top panel 1512 and perimeter panel 1514. That is, in the embodiment depicted in FIGS. 16A and 16B, the top panel 1512 and perimeter panel 1514 are a continuous piece of material connected around the perimeter of a sole. A connecting member 1518, depicted here as a band extends through around the circumference of the perimeter panel 1514 and top panel 1512. Expansion joints 1540 formed as a folded flexible material are disposed along the perimeter panel 1514 and top panel 1512 and are opened or closed by adjusting the effective length and/or tension of the connecting member 1518. Without wishing to be bound by theory, such an arrangement allows for lateral, longitudinal, and vertical adjustment and expansion with a single connecting member.

Figure 17:
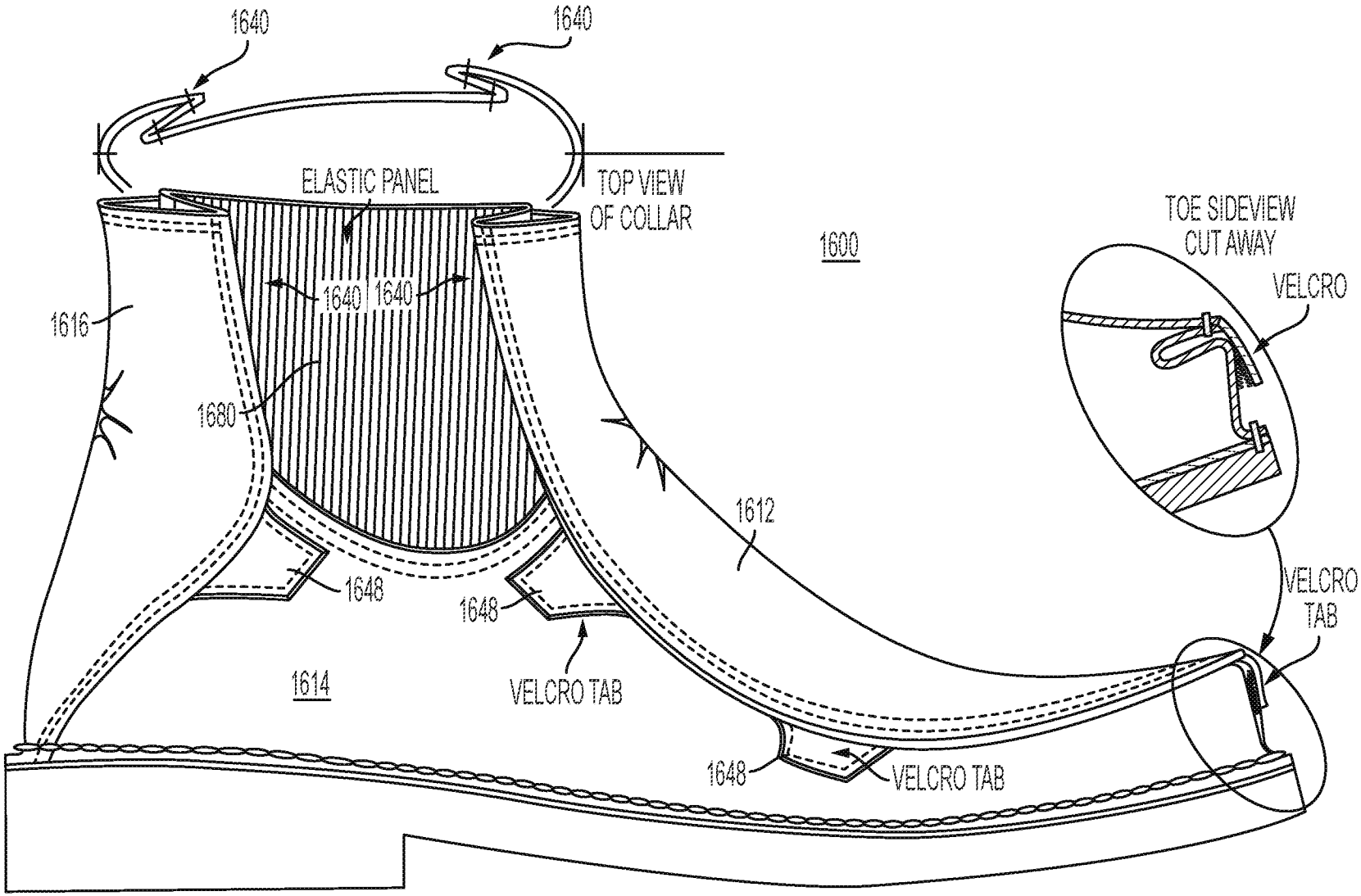
FIG. 17 is a side elevation of yet another embodiment of an adjustable shoe.

FIG. 17 depicts yet another embodiment of an adjustable shoe 1600. The adjustable shoe 1600 includes a top panel 1612, perimeter panel 1614, and heel portion 1616. The top panel 1612 and the heel portion each include fastener tabs 1648 constructed as hook and loop fasteners and arranged to releasably attach the top panel and the heel portion to the perimeter panel 1614. The fastener tabs allow the top panel 1612 and heel portion 1616 to be adjusted upward and longitudinally, while the fastener tabs allow the perimeter panel 1614 to be adjusted laterally outward. The heel portion 1616 and perimeter panel 1614 are connected to the sole with stitching, while top panel 1612 is detached from the sole entirely. The top panel 1612 and heel portion 1616 each include an expansion joint 1640 which are connected by an elastic panel 1680. Accordingly, both the elastic and expansion joints provide additional expandability of the heel portion 1616 and around the ankle region.

FIGS. 18A-18E depict yet another embodiment of an adjustable shoe 1700. The adjustable shoe includes a sole 1702 and an adjustable upper 1710 with an adjustable toe portion 1712, side panels 1714, and adjustable heel portion 1716. The adjustable toe portion 1712 includes a panel 1713 secured at the toe end 1713*a* to the toe 1702*a* area of the sole 1702 and an opening 1722 disposed at a distal end 1713*b* of the toe panel 1713 for receiving a connecting element 1718*a*. The adjustable shoe includes two side panels 1714 secured to the sole on opposite lateral sides of the shoe. Each side panel is arch-shaped and includes at least two separate attachment regions 1714*a*, 1714*b*, with the forward attachment region 1714*b* being attached to a toe end region of the sole and the rearward attachment region 1714*a* being attached to a heel end region of the sole such that at least a mid-portion 1714*c* of the side panel is free from direct attachment to the sole. Without wishing to be bound by theory, such a construction allows for the side panels to bend outward more easily at the mid-portion to more readily adjust to varying widths of a wearer's foot. Each side of the adjustable side panels includes at least one opening 1722 for receiving at least one connecting element 1718*a*, 1718*b*. The heel portion 1716 is secured to heel 1702*b* of the sole and includes at least one opening 1722 for receiving a connecting element 1718*b*. The heel portion 1716 includes an upper edge 1716*a* and side edges or wings 1716*b*. The heel portion also includes a lower edge 1716*c* that is connected directly to the sole.

The toe portion, side panels, and heel portion are independent and moveable relative to each other, as each is independently secured to the sole. As is clearly shown in FIGS. 18A-18C, the connecting elements 1718*a*, 1718*b* releasably secure the toe portion to the side panel and the heel portion to the side panels, respectively. The connecting elements may be a lace, elastic band, or any other suitable arrangement for allowing a wearer to adjust the relative positioning of the adjustable upper components. As depicted in FIGS. 18A-18E, the connecting elements 1718*a*, 1718*b* are constructed as an elastic lace. The connecting members, 1718*a*, 1718*b* include locks 1790*a*, 1790*b* which may be used to adjust the tension and/or effective length of the connecting members. As depicted in FIGS. 18A-18E, the locks 1790*a*, 1790*b* are arranged as spring-loaded cord locks, although any suitable arrangement may be employed, such as knots or other releasable fasteners. Without wishing to be bound by theory, by adjusting the tension and/or effective length of the connecting element in different areas of the shoe, the adjustable upper 1710 may expand or contract to accommodate size variations in different regions of the wearer's foot.

Figure 18A:
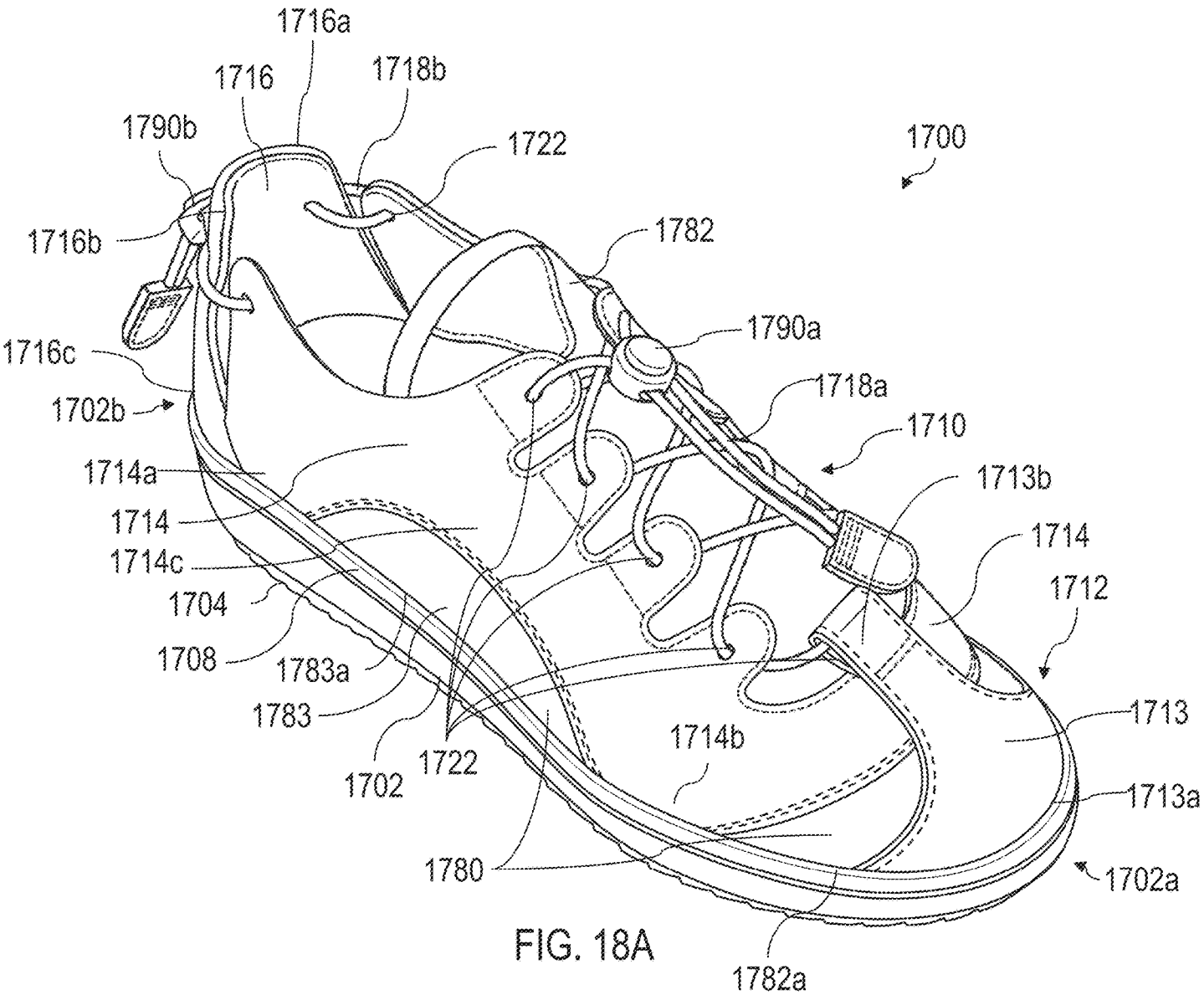
FIGS. 18A-18D depict various views of yet another embodiment of an adjustable shoe.
Figure 18B:
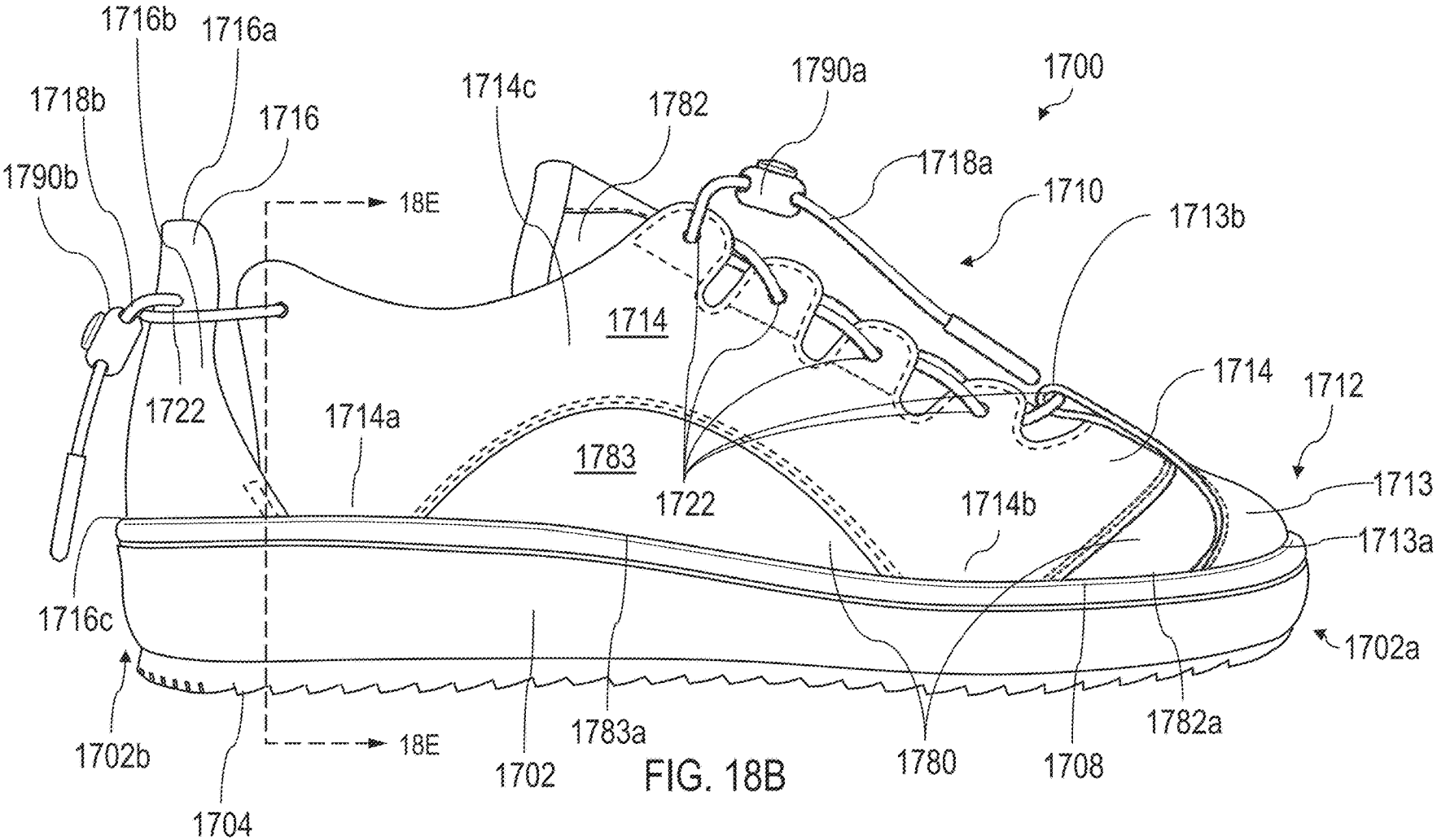
Figure 18C:
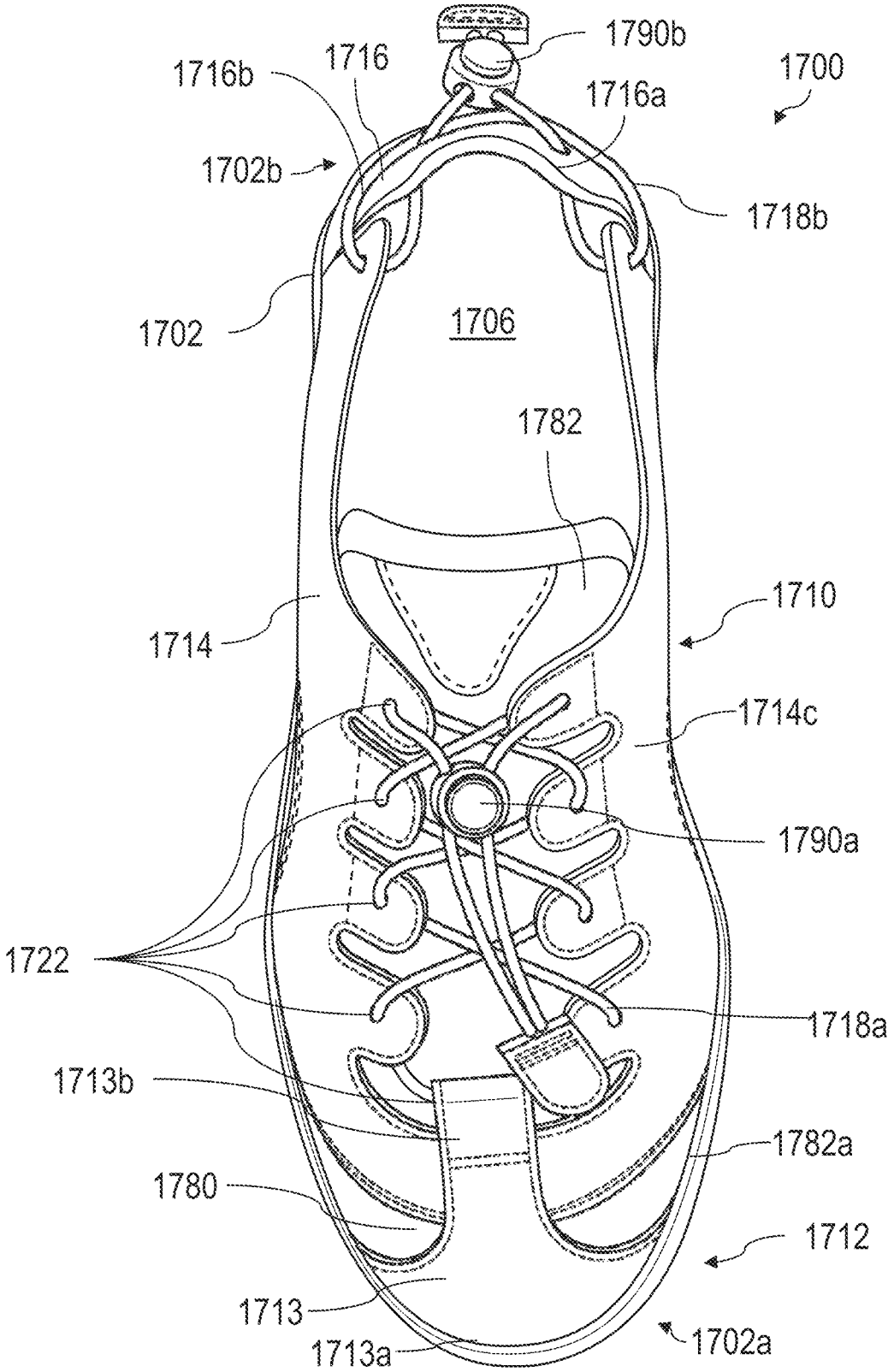
Figure 18D:
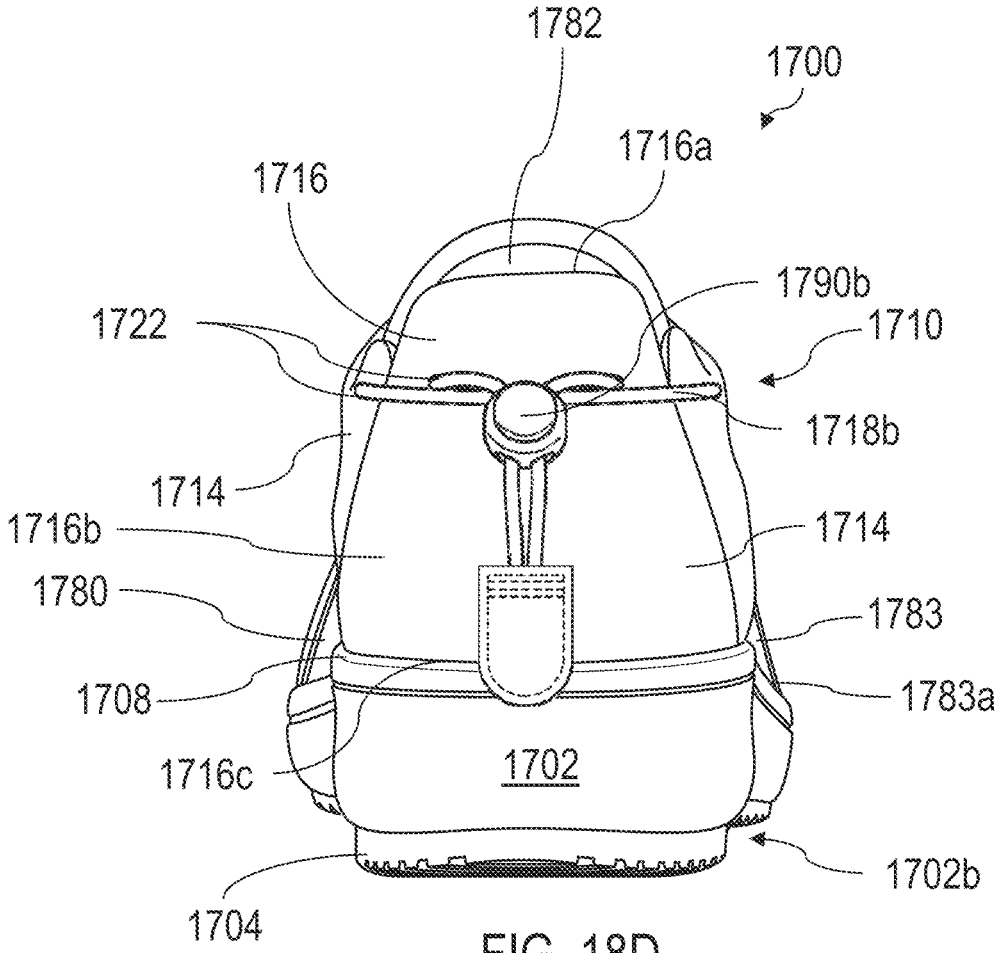

Continuing with FIGS. 18A-18B, the adjustable shoe 1700 includes a stretch liner 1780. The stretch liner may be formed as a single component or multiple components. In one embodiment, the stretch liner 1780 includes a tongue liner 1782 and side liners 1783. With respect to the side liners 1783, a lower edge 1783*a* is attached along an outer periphery 1708 of the sole 1702 such that the side liner 1783 covers any gaps between the side panel attachment regions 1714*a* and 1714*b*. In one embodiment, a lower edge 1782*a* of the tongue liner 1782 is attached to the sole such that the tongue liner covers any gaps between the toe portion 1712 and side panels 1714. Thus, the stretch liner is connected adjacent to the toe portion 1712 along the outer periphery of the sole, but is not directly attached to the toe portion. In this respect no portion of the inner surface of the toe panel 1713 is attached to the opposing surface of the liner. Optionally, the stretch liner 1780 may be arranged to cover the gaps between the side panels 1714 and the heel portion 1716 such that a wearer's foot is not visible. Without wishing to be bound by theory, the stretch liner allows for any temporary or permanent foot size variations while enclosing the foot. The adjustable upper 1710 may be adjusted around various regions of the shoe to provide support to the foot without impeding expansion provided by the stretch liner. In some embodiments, the adjustable upper may be composed of a more rigid, non-stretch fabric or material, such that the adjustable upper may be tightened or loosened in discrete regions of the foot for support while allowing for the combined expansion of the stretch liner and adjustable upper to accommodate any swelling or other medical conditions.

According to the embodiment depicted in FIGS. 18A-18E, the adjustable upper 1710 allows for expansion and adjustment in three directions, namely the length direction, the height direction and the width direction. The adjustable toe portion 1712 allows for longitudinal and vertical adjustment through manipulation of tension and/or effective length on the connecting member 1718*a* through the opening 1722 positioned on a distal end of the toe portion. That is, the toe portion 1712 may be moved longitudinally (i.e., lengthwise) to allow for size variations in the length of the foot, and may be moved upwardly (i.e., vertically) to allow for size variations in the height of the foot near the toes. The adjustable side panels 1714 allow for vertical and lateral adjustment through manipulation of the tension and/or effective length of the connecting member 1718*a*. That is, the upper edges of the side panels may be moved laterally (i.e. widthwise) to allow for size variations in the width of the foot as well as upwardly (i.e., vertically) to allow for size variations in the height of the midfoot. As can be appreciated, this is accomplished by fixing the lower edge of the side panel to the sole whereas the upper free edge of the side panel is moveable. The adjustable heel portion 1716 allows for longitudinal and lateral adjustment through manipulation of tension and/or effective length on the connecting member 1718*b* through the opening 1722 positioned on the heel portion. That is, the upper edge 1716*a* of the heel portion may be moved longitudinally (i.e., lengthwise) to allow for size variations in the length of the foot, and the side edges or wings 1716*b* of the heel portion may be moved laterally (i.e., widthwise) to allow for size variations in the width of the foot near the ankle and heel. Thus, the adjustable upper can accommodate a wide variety of permanent and temporary foot shapes with a simple adjustment of the connecting members 1718*a*, 1718*b*. According to one embodiment, the shoe 1700 may effectively expand up to 1.5 US shoe sizes to accommodate any foot size increase or foot size variations.

Figure 18E:
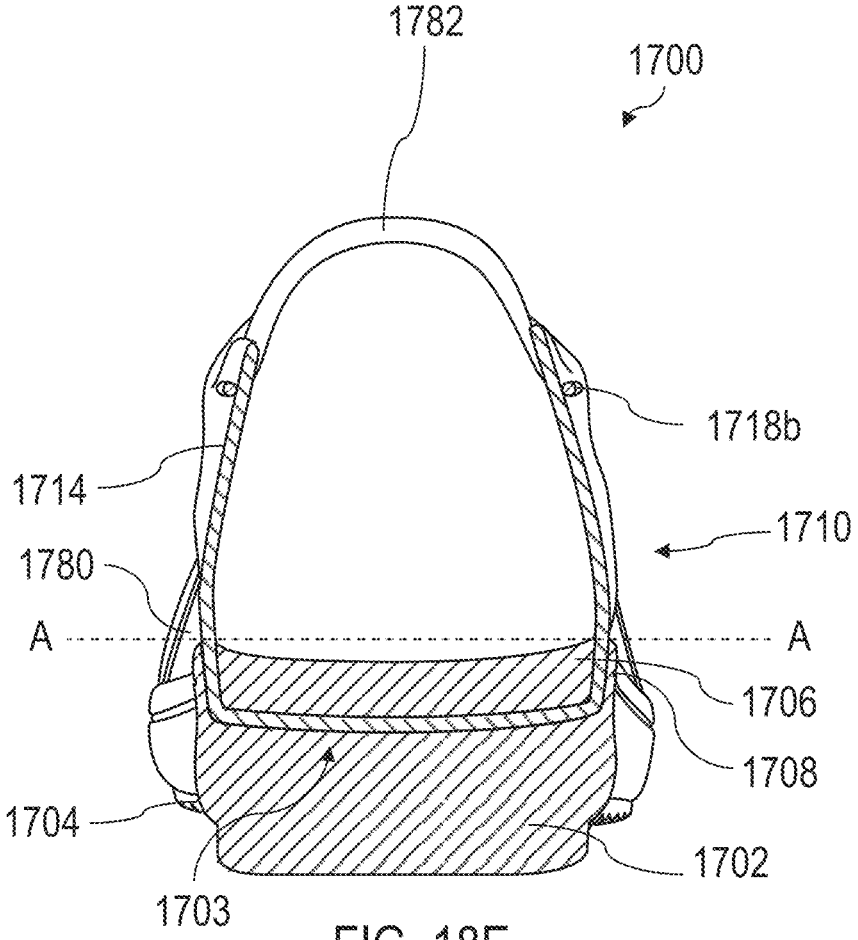
FIG. 18E is a transverse cross-sectional view taken along taken along line 18E-18E of FIG. 18B.

As shown best shown in FIG. 18E, which is a transverse cross sectional view taken along line 18E-18E of FIG. 18B, the adjustable shoe 1700 includes an inset footbed 1706. More specifically, the footbed 1706 is positioned in a recess 1703 in the sole 1702, such that an uppermost portion of the footbed 1706 is effectively aligned height-wise with an uppermost portion of the outer periphery 1708 of the sole 1702 (at approximately dashed line A). Accordingly, when the shoe 1700 is worn, the bottom of a foot will be effectively aligned with an uppermost portion of the outer periphery 1708 of the sole 1702. As the flexible or movable portions of the adjustable upper 1710 and stretch liner 1780 begin at the uppermost portion of the outer periphery, the only non-adjustable boundary of a foot-containing volume is the footbed 1706. Thus, the adjustable upper 1710 may expand to account for any height, length, or width foot size changes without any non-adjustable portion of the shoe (e.g., the sole 1702) impeding the expansion. In some embodiments, the footbed 1706 may be removable, such that the footbed may be replaced with a custom orthotic. Thus, any orthotic may be securely received by the recess 1703 while providing the adjustability and expansion of the upper 1710.

Figure 19A:
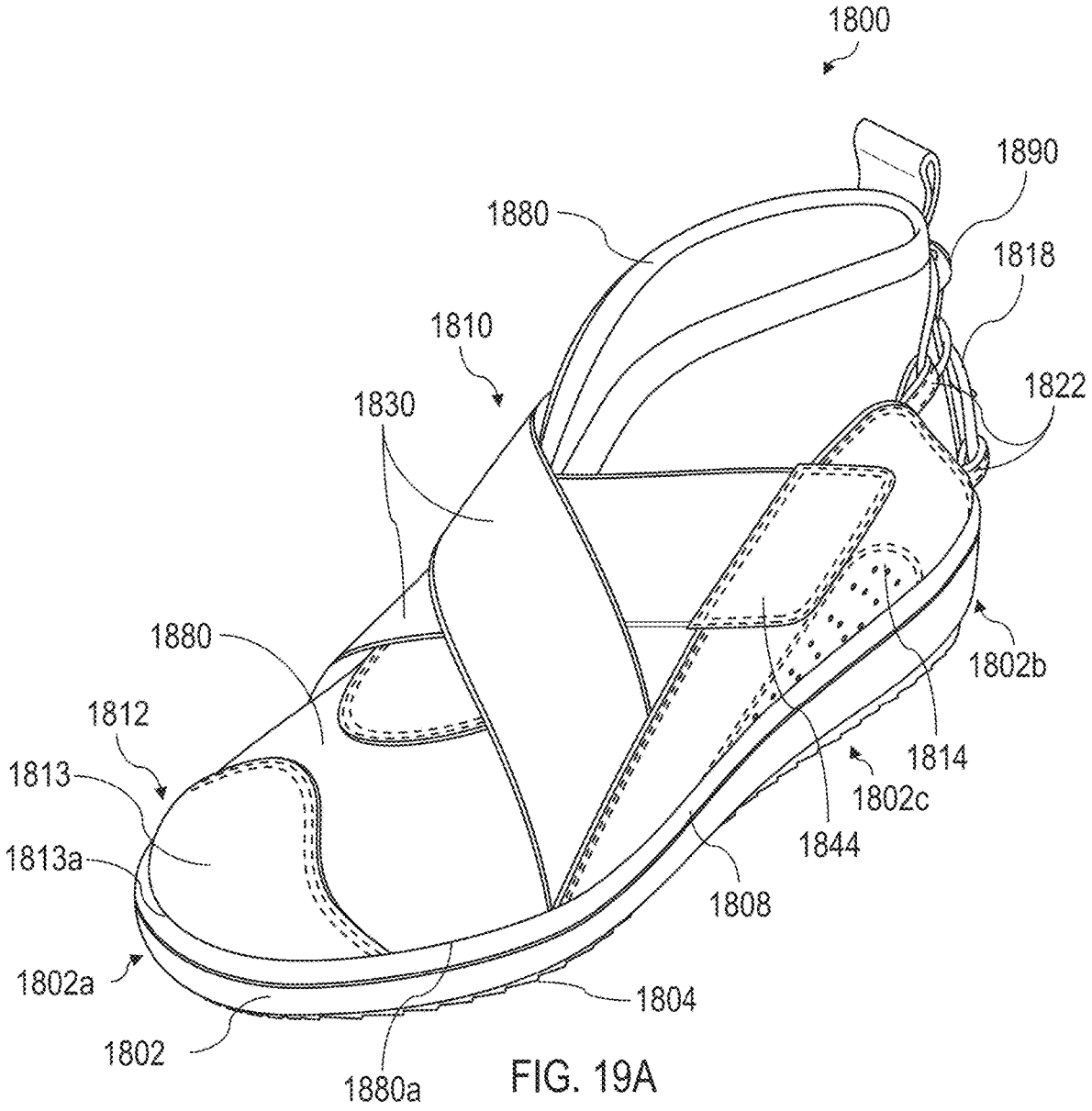
FIGS. 19A-19D depict various views of yet another embodiment of an adjustable shoe.
Figure 19B:
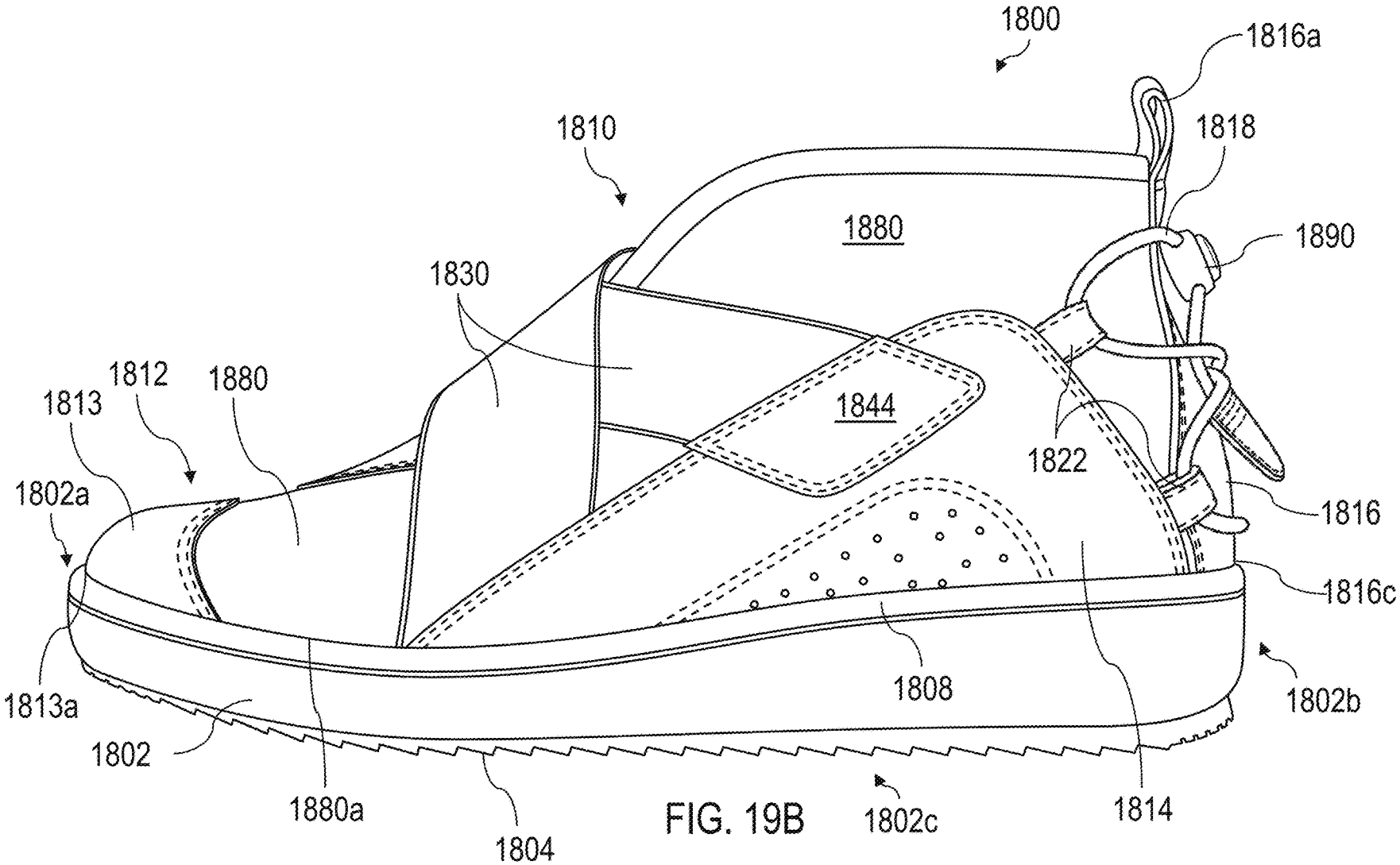
Figure 19C:
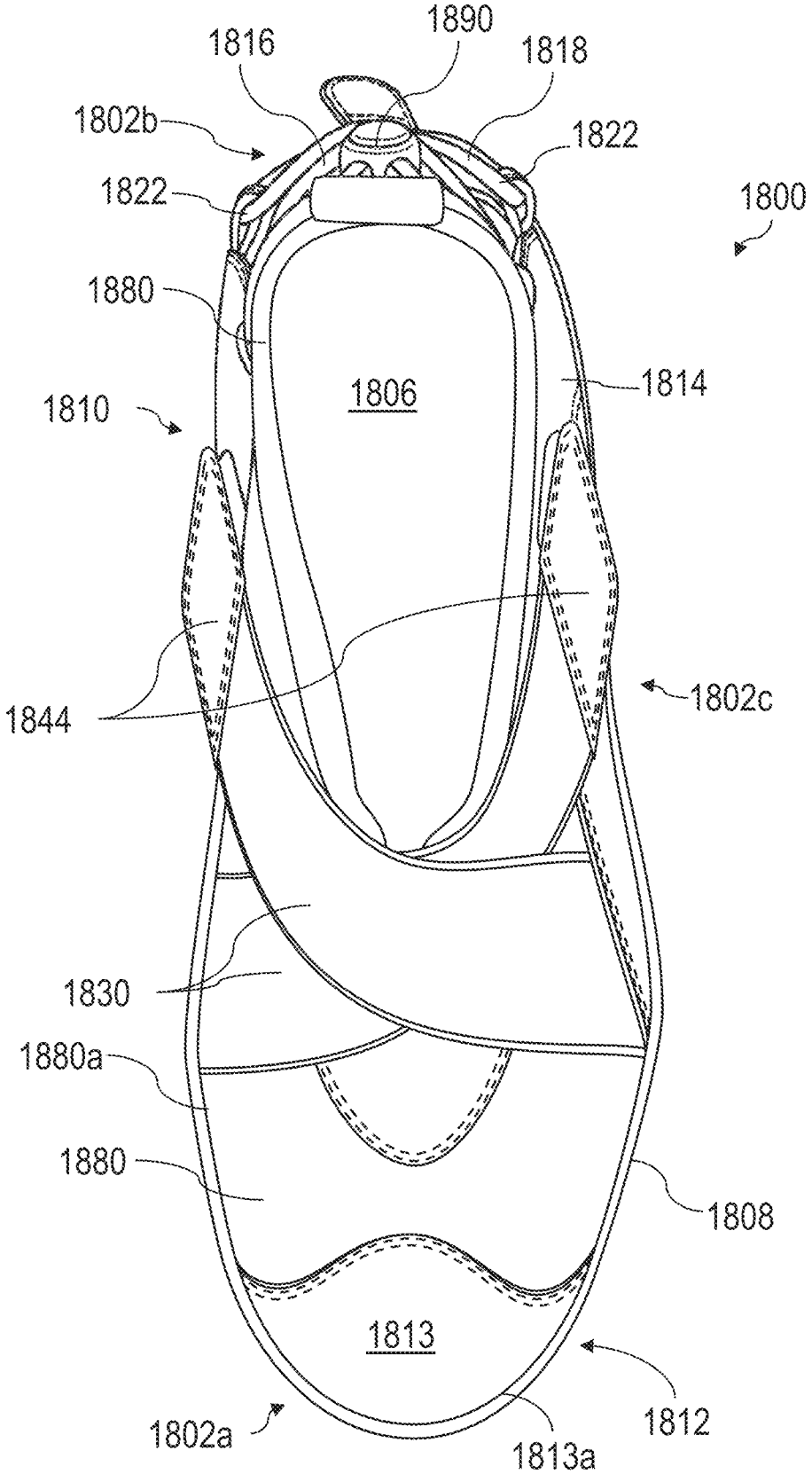

FIGS. 19A-19D depict yet another embodiment of an adjustable shoe 1800. The adjustable shoe 1800 includes a sole 1802 and an adjustable upper 1810 with a toe portion 1812, side panels 1814, and heel portion 1816. The toe portion 1812 includes a panel 1813 secured at the toe end 1813*a* to the toe 1802*a* area of the sole 1802. Accordingly, other than the attachment between the toe portion 1812 and the sole 1802 along the outer periphery 1808, the toe portion is free to move relative to the rest of the shoe. Without wishing to be bound by theory, such an arrangement may allow for additional longitudinal and vertical expandability of the toe portion. The side panels 1814 are secured to the sole 1802 along a midfoot region 1802*c* of the sole 1802. As best shown in FIG. 19C, each side panel 1814 includes an elastic strap 1830 which is secured to the sole on a proximal end adjacent the side panel and includes a strap fastener 1844. The elastic strap fastener 1844 is configured to releasably attach to the opposing side panel. That is, a first elastic strap extends from a first side where it is attached to the sole 1802 adjacent a first panel to a second side where it is releasably attached to a second side panel via the strap fastener 1844. Similarly, a second elastic strap extends from the second side to the first side panel. Accordingly, the elastic straps 1830 may be used to secure the shoe 1800 to a wearer's foot and allow a user to adjust the width and height of the side panels. In the embodiment depicted in FIGS. 19A-19D, the strap fastener 1844 is a hook and loop fastener which allows the strap fastener to be attached in different positions for adjustability of the side panels 1814. In other embodiments, any suitable releasable fastener that allows for adjustment of the elastic straps, such as snap fasteners or buttons may be employed. The side panels 1814 include openings 1822 for receiving a connecting element 1818 which is positioned around a perimeter of the heel portion 1816. The heel portion 1816 is secured to heel 1802*b* of the outer periphery 1808 of the sole 1802 and includes an upper edge 1816*a* and a lower edge 1816*c* that is connected directly to the sole. The toe portion, side panels, and heel portion are independent from one another and secured to the sole separately. Accordingly, the toe portion, side panels, and heel portion are all adjustable and expandable independently to accommodate foot size variations.

Figure 19D:
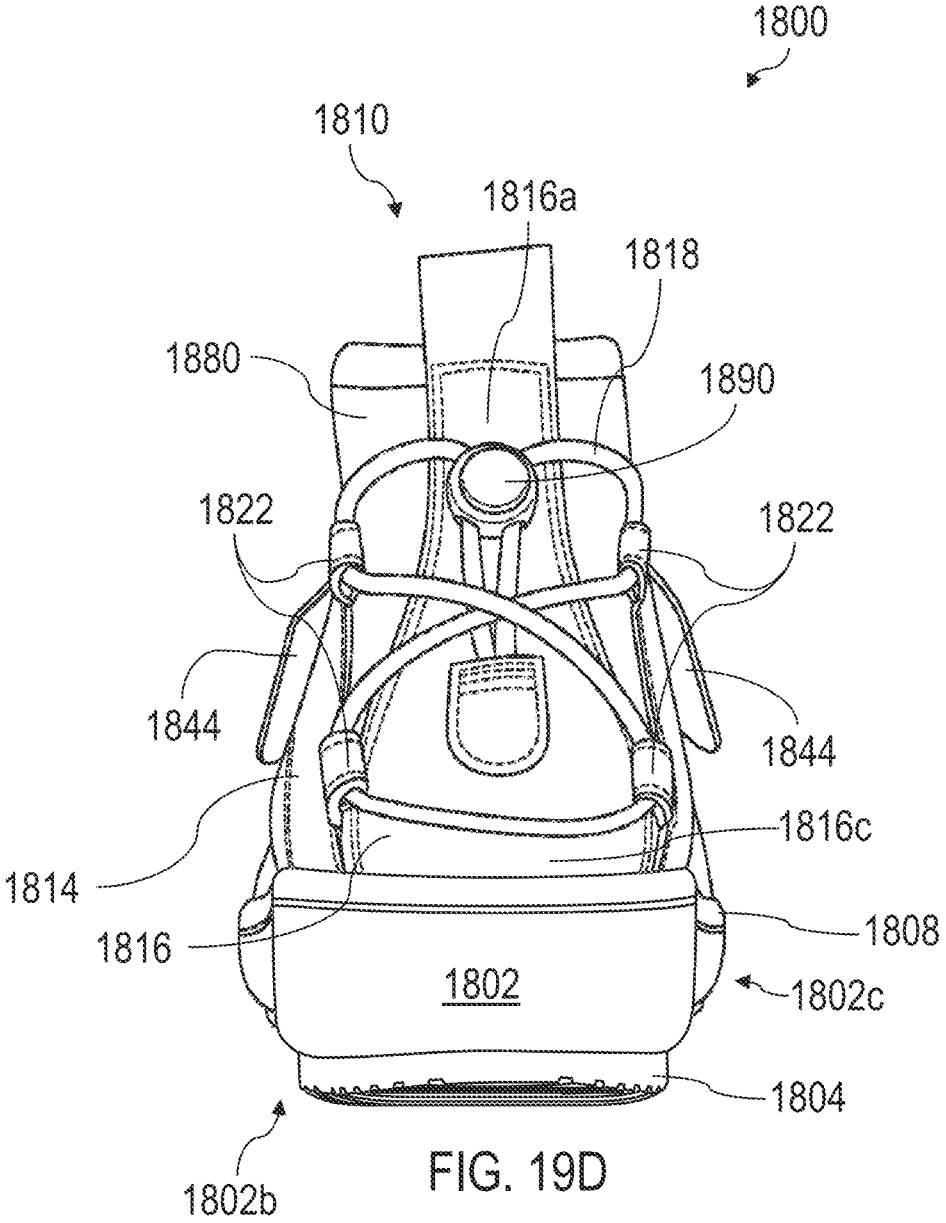

In the embodiment depicted in FIGS. 19A-19D, the shoe 1800 may be adjustable using a combination of the elastic straps 1830 and connecting member 1818 to expand in three directions. Automatic or manual adjustment of the elastic straps 1830 provides vertical and lateral adjustment of the side panels 1814. In some embodiments, the elastic bands with be substantially stretchy, such that they may expand significantly along the length of the band. According to this embodiment, if any foot swelling or other foot size variations need to be accommodated in the vertical direction, the elastic straps may automatically stretch and expand the shoe. Similarly, as the elastic bands 1830 control the lateral adjustment of the side panels 1814, any width size variations may also be accommodated through the automatic stretching of the elastic bands. Manual adjustment of the bands (i.e., releasing the strap fastener 1844) may provide additional expansion of the side panels 1814. By adjusting the tension or effective length of the connecting member 1818 using lock 1890, the heel portion 1816 is adjustable longitudinally or laterally to provide expansion in the heel or ankle region of a wearer's foot. As best shown in FIG. 19D, the connecting member is connected through openings 1822 on the side panels 1814 and positioned around a perimeter of the heel portion 1816. Accordingly, by reducing the effective length or increasing the tension of the connecting member 1818, the heel portion may be brought closer towards the openings 1822. In the opposite direction, increasing the effective length or decreasing the tension of the connecting member 1818 allows the heel portion 1816 to expand away from the openings 1822 and increase the length and/or width of the shoe in the ankle and heel region of a wearer's foot. As the toe portion 1812 is not connected to either side panels 1814 or heel panel 1816, the toe portion is free to expand vertically or longitudinally automatically. Thus, the shoe 1800 allows for vertical, lateral, and longitudinal adjustment to accommodate foot size variations in various regions of a wearer's foot. According to the depicted embodiment, the shoe 1800 may effectively expand up to 1.5 US shoe sizes to accommodate any foot size increase or foot size variations.

As shown best in FIGS. 19A-19B, the shoe 1800 includes a stretch liner 1880. The stretch liner 1880 is attached along the outer periphery 1808 of the sole to cover any gaps between the various components of the adjustable upper 1810, including the toe portion 1812, side panels 1814, and heel portion 1816. In the embodiment depicted in FIGS. 19A-19D, the stretch liner 1880 is connected to each of the side panels 1814, between the side panels and the heel portion 1812, and around the outer periphery 1808 of the toe 1802*a* of the sole 1802 along a lower edge 1880*a* of the stretch liner. That is, the stretch liner is connected around the outer periphery of the toe of the sole adjacent the toe portion, but is not directly attached to the toe portion. In this respect no portion of the inner surface of the toe panel 1813 is attached to the opposing surface of the liner. Accordingly, the stretch liner 1880 and the toe portion 1812 are independently adjustable relative to one another. As discussed previously, the stretch liner allows for any temporary or permanent foot size variations while fully enclosing the foot.

Figure 20A:
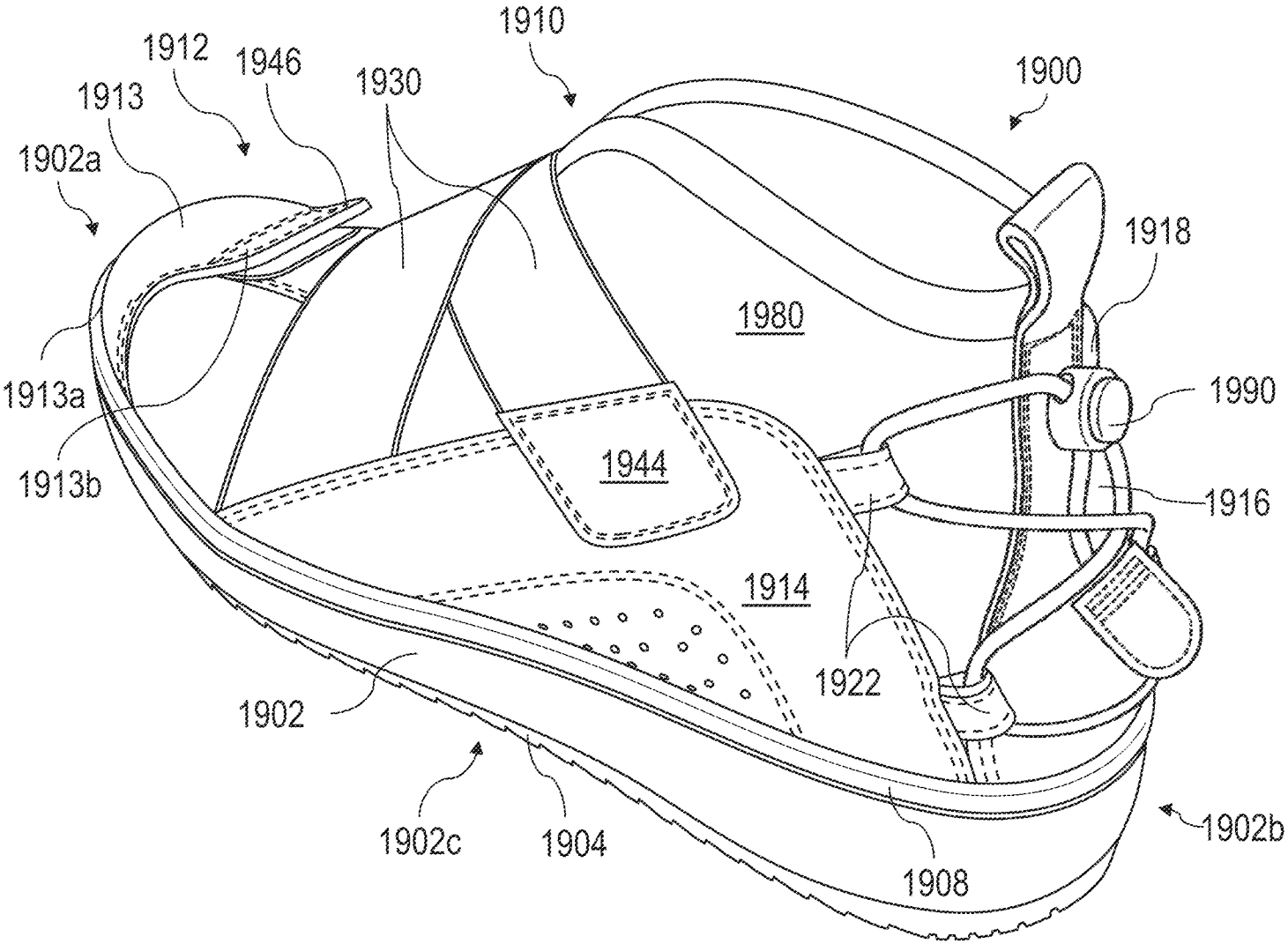
FIGS. 20A and 20B are perspective and side elevation views, respectively, of yet another embodiment of an adjustable shoe.
Figure 20B:
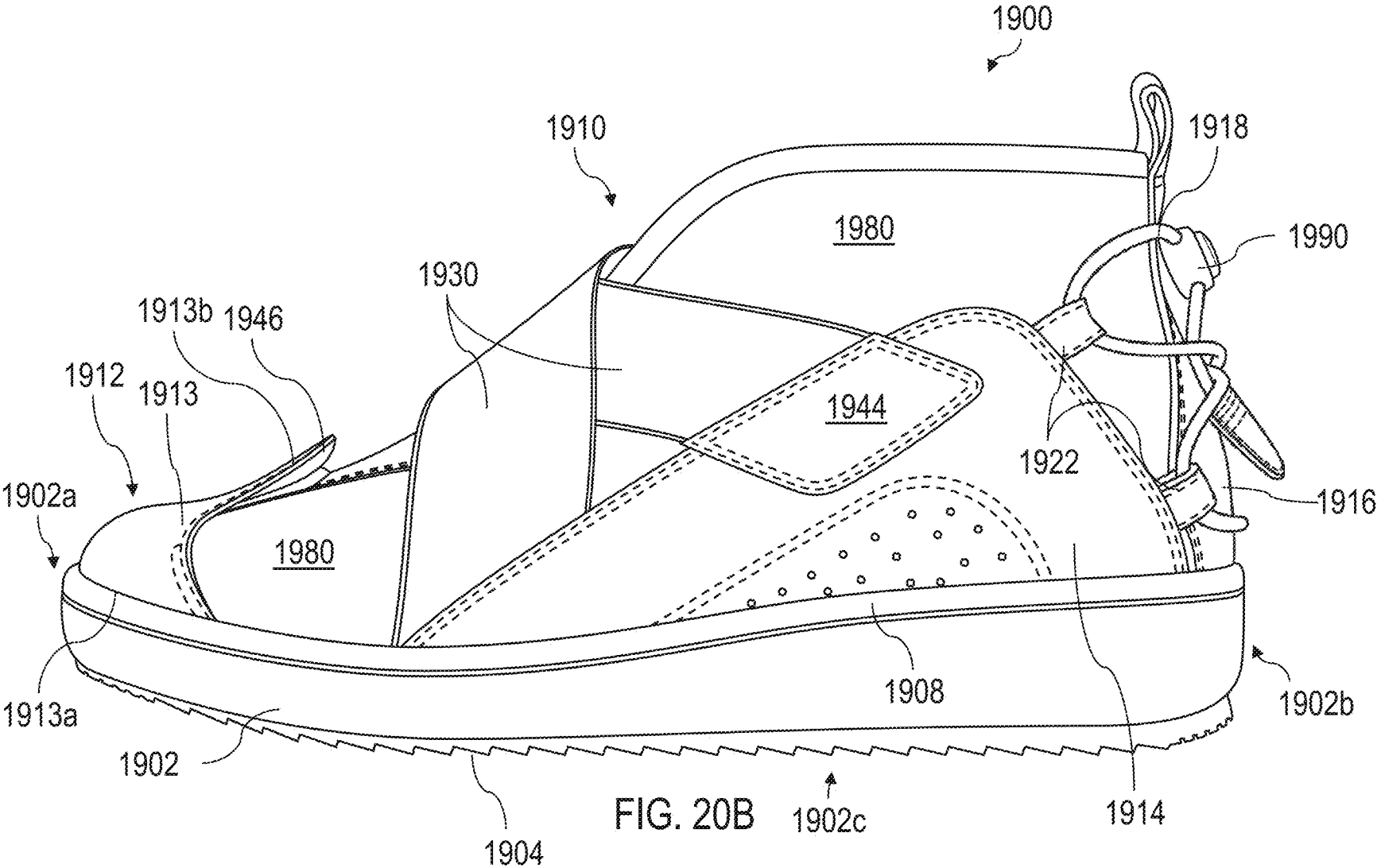

FIGS. 20A-20B depict yet another embodiment of an adjustable shoe 1900. The shoe 1900 is similar to the embodiment of an adjustable shoe depicted in FIGS. 19A-19D, with the shoe including a sole 1902 and an adjustable upper 1910 with a toe portion 1912, side panels 1914, and heel portion 1916. As discussed previously, the toe portion, side panels, and heel portion are independently adjustable relative to one another using elastic straps 1930 and a connecting member 1918, such that the shoe may be adjusted to accommodate foot size variations in various regions of the shoe. As compared with the embodiment depicted in FIGS. 19A-19D, the toe portion 1912 of shoe 1900 includes a fastener 1946 positioned on a distal end of the toe portion to releasably attach the toe portion to a stretch liner 1980. According to the embodiment depicted in FIGS. 20A-20B, the fastener is a hook and loop fastener. Of course, any suitable releasable fastener, such as a snap fasteners or a buttons may be used to attach the toe portion to the stretch liner. Thus, the fastener 1946 allows for manual adjustment of the toe portion 1912, such that the toe portion may be expanded longitudinally or vertically. Additionally, the fastener 1946 may be attached to the stretch liner 1980 to indirectly connect the toe portion and the side panels 1914 such that additional support is provided to the foot when additional expandability is not needed (e.g., when swelling has subsided).

Without wishing to be bound by theory, the expandability of an adjustable shoe upper according to embodiments described herein may be characterized through last testing. For example, lasts with different dimensions in various regions (corresponding to various regions of the foot) may be tested for fit within an adjustable shoe of the same nominal size. The lasts may be measured in one or more areas so that the internal dimensions (e.g., volume) of the adjustable shoe may be measured as the shoe is expanded. That is, a last with larger dimensions in one or more regions may cause the adjustable shoe to expand to accommodate the larger dimension. Accordingly, by varying the dimensions of the lasts and comparing them to a nominal size, the expansion of the adjustable shoe may be measured in one or more directions (e.g., longitudinally, transverse, vertically, etc.). Additionally, the expandability of the shoe may be measured in terms of cross-sectional area expansion (transverse or longitudinally) or volumetric expansion. The dimensions of the last may be increased in one or more regions until the last is no longer accommodated by the adjustable shoe. The largest dimensions which fit in the adjustable shoe may be used to characterize the amount of expansion the adjustable shoe is capable of. In some embodiments, the bottom dimensions of the testing lasts may be held constant and the upper regions of the testing last (i.e., above the sole region of the last) may have varied dimensions. Without wishing to be bound by theory, such an arrangement may be desirable to characterize the swelling of a wearer's foot which typically swells in the upper regions away from the sole of the foot. That is, in some cases, the sole of an unswollen foot and a swollen foot may have approximately equivalent dimensions on the sole but vary in dimensions along the upper regions of the foot.

Figure 21A:
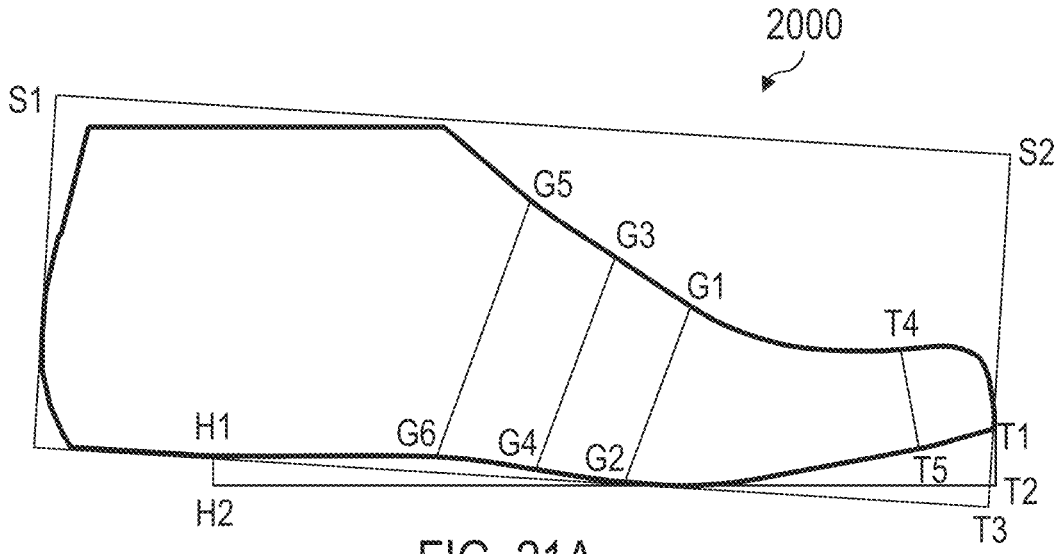
FIGS. 21A and 21B depict side elevation and bottom plan views, respectively, of one embodiment of a last for last testing an adjustable shoe.
Figure 21B:
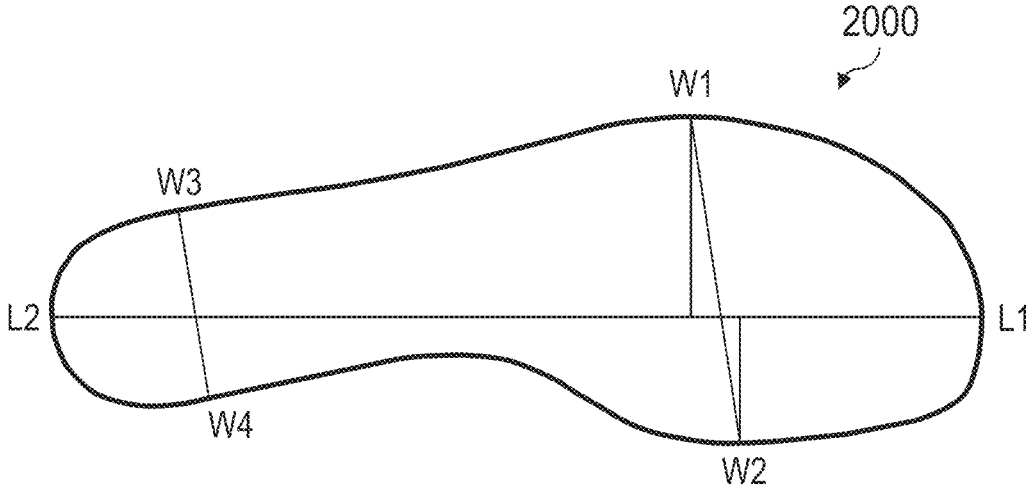

FIGS. 21A-21B depict exemplary measurement regions of a last 2000 for performing last testing of an adjustable shoe to characterize volumetric expandability. As shown in FIGS. 21A-21B, multiple measurements may be taken of the last with reference to each of the labeled lines. FIG. 21A depicts an elevation view of the last 2000. In the embodiment shown in FIG. 21A, the stick of the last may be measured as a linear distance between S1 and S2. The circumference of various regions of the last may also be measured. In the embodiment shown in FIG. 21A, the ball girth is a circumference measured in the region along the line G1 to G2, the waist girth is measured in the region along line G3 to G4, and the instep girth is measured in the region along line G5 to G6. Each of these measurements may correspond to a circumference of the last along a particular transverse cross section. As shown in FIG. 21A, the toe spring distance T1 to T2 may be measured as well as the toe thickness T4 to T5. Similarly, the heel pitch distance H1 to H2 may also be measured.

FIG. 21B depicts a plan bottom view of the last 2000. As shown in FIG. 21B, multiple measurements of the last may be taken along the bottom of the last to characterize the volume expandability of an adjustable shoe. The bottom length may be measured along L1 to L2. The bottom width may also be measured along line W1 to W2 and the last bottom paper (LBP) heel width may be measured along line W3 to W4. Approximate volumes may be calculated using these measurements and the other measurements described above, which may be useful for characterizing the expandability of the adjustable shoe. Of course, any suitable measurements of the last may be taken, as the present disclosure is not so limited.

Without wishing to be bound by theory, the measurements described with reference to FIGS. 21A-21B may be used to calculate approximate volumes which are useful for characterizing the expandability of an adjustable shoe upper. According to one embodiment, the ball girth, waist girth, and instep girth may be used to compute an approximate volume of the last corresponding to the internal volume of the adjustable shoe. In this embodiment, some assumptions are made for simplicity in calculating the approximate volume of the adjustable shoe. First, the transverse cross section corresponding to the measured girth is assumed to be circular. As a result, a computed radius of the circular cross section, r, is found from the equation:

$$r = \frac{G}{2\pi}$$

where G is the measured circumference or girth in the specified region (e.g., ball, waist, instep). Accordingly, the calculated cross-sectional area of the internal volume of the shoe may be calculated by the equation:

$$A = \frac{G^2}{4\pi}$$

Second, it is assumed that the internal volume of the adjustable shoe may be approximated by a cylinder which extends a length equivalent to the stick length of the last. Accordingly, for a given cross-sectional area derived from the girth measured in a particular region, the volume is calculated the equations:

$$V = A * L$$

$$V = \frac{G^2 L}{4\pi}$$

where L is the stick length of the last. Thus, for each girth measurement, a corresponding volume may be calculated for comparisons between lasts. For example, a ball volume, waist volume, and instep volume may all be individually calculated to characterize expandability of the shoe on average or based on a specified region. In some embodiments, the length of the cylinder may be assumed to be less than the stick length of the last, so that the expandability of a particular region of the adjustable shoe may be characterized. According to this embodiment, the expandability of one region of the shoe may be compared with another region of the shoe.

Figure 22A:
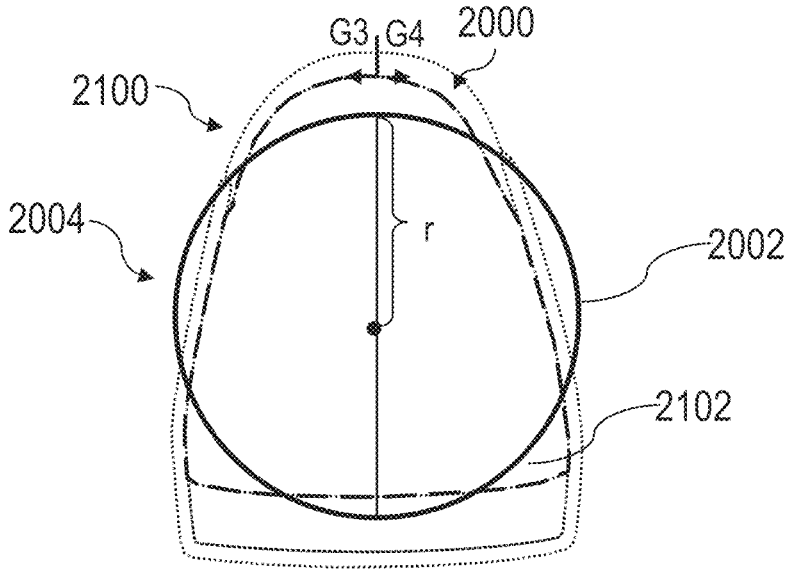
FIGS. 22A-22B depict a transverse cross-sectional view and a side elevation view, respectively, of one embodiment of an internal volume of an adjustable shoe calculated through last testing using the last of FIGS. 21A-21B.
Figure 22B:
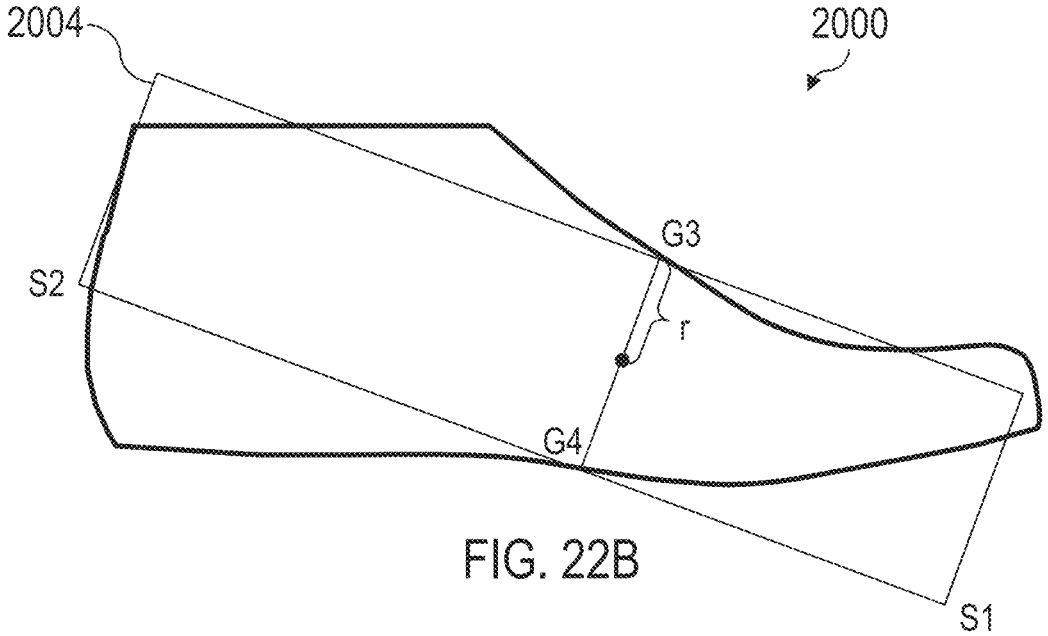

FIGS. 22A to 22B depict one embodiment of an internal volume 2102 of one embodiment of an adjustable shoe 2100 based on a circumference measurement on a last 2000. According to the embodiment shown in FIGS. 22A-22B, it is assumed the internal volume 2102 is approximated by a cylinder 2004 with a circular cross section 2002 corresponding to the measured girth. FIG. 22A shows a transverse cross sectional view of the last 2000 in long dashed lines surrounded by the adjustable shoe 2100 in short dashed lines. An overlaid circular cross-section 2002 is shown as an approximate cross-sectional area corresponding to the circumference measured along G3 to G4 of the last (e.g., the waist girth). A radius r of the circular cross-section may be derived according to the equations described above from the circumferential measurement of the last in order to compute a cross-sectional area of the last in the region of measurement. As shown in FIG. 22B and discussed previously, the internal volume of the adjustable shoe is assumed to be approximately equal to that of a cylinder 2004 extending a length equal to the stick length of the last between S1 and S2 (for example, see FIG. 21A). Accordingly, the volume of the cylinder may be calculated from the equations described above. After the occupied volume of the last is calculated based on one or more measurement regions for a nominally sized last and one or more larger lasts which expand the shoe, the amount of volume expansion may be determined by comparing the calculated volumes. In particular, a volume expansion ΔV based on a particular circumferential measurement can be calculated by the equation:

$$\Delta V = V_{max} - V_{nom}$$

where $V_{max}$ is the calculated volume based on the largest last which fits the adjustable shoe and $V_{nom}$ is the calculated volume based on a nominally sized last which fits the adjustable shoe.

Figure 23A:
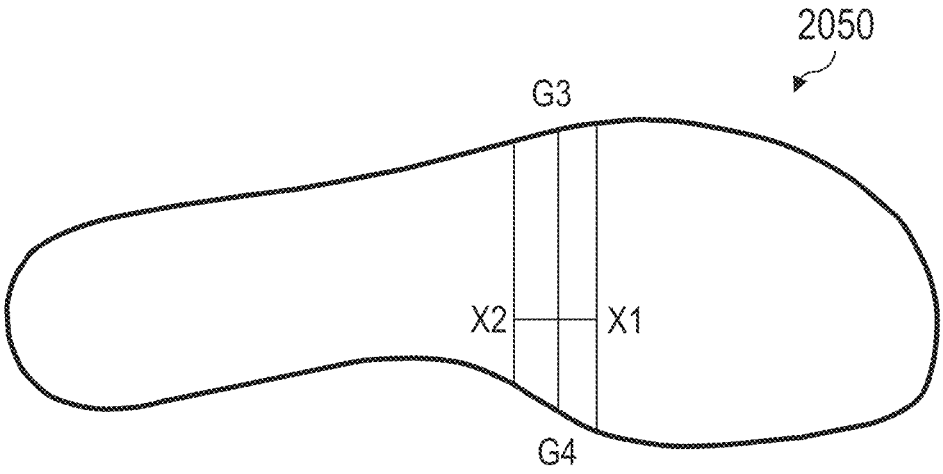
FIG. 23A depicts a bottom plan view of another embodiment of a last for last testing an adjustable shoe.
Figure 23B:
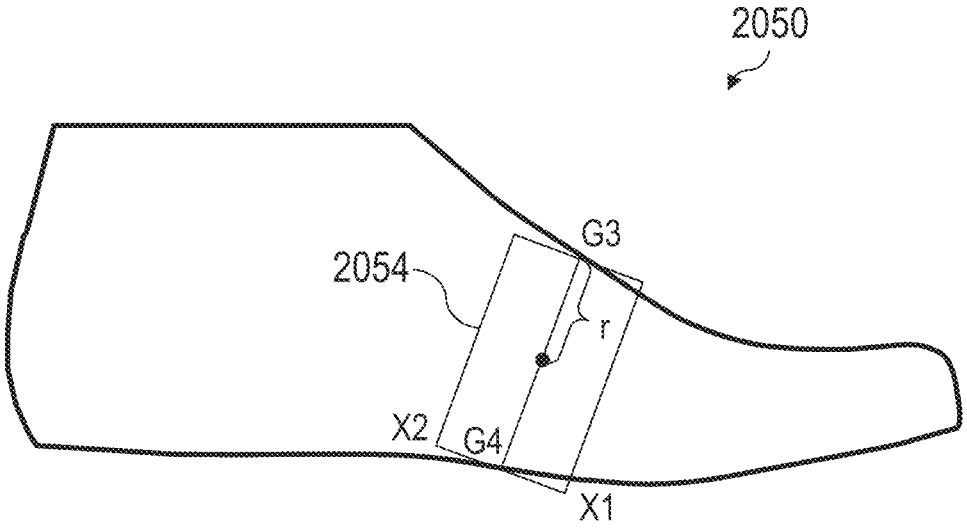
FIG. 23B depicts a side elevation view of another embodiment of an internal volume of an adjustable shoe calculated through last testing using the last of FIG. 23A.

FIGS. 23A-23B show an alternative embodiment of last testing measurements for an adjustable shoe. In some cases, rather than measuring the overall stick length for calculating an approximate volume of the entire adjustable shoe, it may be desirable to measure a smaller length corresponding to a particular region of the foot to characterize expandability in that specific region. As shown in the bottom plan view of the last 2050 in FIG. 23A, the waist length is measured along line X1-X2 on the sole of the last. The waist length corresponds to a waist girth which is a circumference measured along the region of line G3-G4. With these measurements, the same assumptions regarding the volume of the shoe may be made, so that the volume of the waist region is approximated by a cylinder 2054 with a length corresponding to the waist length (i.e., X1-X2), as shown in FIG. 23B. The radius, r, of the cylinder may be derived from the waist girth assumed to be the circumference of a circular cross section. Thus, the volume of the cylinder representative of the waist region internal volume may be calculated as described above, and this volume of the waist region compared between differently sized lasts. Accordingly, the expandability of an adjustable shoe in the waist region or any other suitable region may be characterized using the method described.

According to exemplary embodiments described herein, volume expansion of the shoe may be characterized by an expandability coefficient expressed in terms of percentage. The expandability coefficient may be based at least partly on circumferential expansion (i.e., girth expansion) of the adjustable shoe around one or more cross sectional areas of the shoe (for example, see FIG. 18E). The expandability coefficient may be suitable to characterize how much additional volume in different regions the adjustable shoe can accommodate for a nominal shoe size (e.g., US size, Mondopoint, UK size, etc.). Following the cylindrical volume assumptions made in the volume calculations described above, the expandability coefficient ε may be determined from the equation:

$$\varepsilon = \frac{\Delta V}{V_{nom}}$$

where ΔV is the volume expansion derived from circumferential measurements of a nominally sized last and a largest last which fits the adjustable shoe, and $V_{nom}$ is a calculated volume from a measurement of the nominally sized last. Alternatively expressed, the expandability coefficient ε may be given by the equation:

$$\varepsilon = \frac{G_{max}^2}{G_{nom}^2} - 1$$

where $G_{max}$ is a girth (i.e., circumferential) measurement around a transverse region of the largest last which fits in an adjustable shoe and $G_{min}$ is a girth measurement around the same transverse region of a nominally sized last which fits in an adjustable shoe. According to this embodiment, the expandability coefficient may correspond to a percentage volumetric expansion capability where the transverse region is assumed to be a circle and the volume is a cylinder with a length corresponding to a length of the last (e.g., an overall length or partial length).

In some embodiments, an adjustable shoe may have regions with an expandability coefficient of greater than or equal to 6%, 7%, 8%, 12%, or 15, or any other suitable factor. Correspondingly, the expandability coefficient of certain regions may be less than 20%, 15%, 12%, 8%, or any other suitable factor. Combinations of the above noted ranges are contemplated, such as expandability coefficients between 8% and 12%, 12% and 20%, as well as 7% and 15%. Of course, any suitable expandability coefficient may be employed for a region of an adjustable shoe to provide sufficient volumetric expansion for various portions of a wearer's foot, as the present disclosure is not so limited.

In some cases, it may be desirable to normalize the calculated volumes based on the standard shoe size of the measured adjustable shoe. For example, normalizing for shoe size may allow volume expansion to be predicted for an adjustable shoe at any given shoe size. According to one embodiment, a predicted volume for a shoe size, $V_a$, may be calculated based on a circumferential measurement of a last with the cylindrical assumptions described above by the equations:

$$G_a = G_m * \frac{S_a}{S_m}$$

$$L_a = L_m * \frac{S_a}{S_m}$$

$$V_a = \frac{G_a^2 L_a}{4\pi}$$

where $G_a$ is the predicted girth measurement for a given shoe size, $G_m$ is the circumferential measurement of the measured last, $S_a$ is the predicted shoe size, $S_m$ is the measured shoe size, $L_a$ is the predicted length measurement for a given shoe size, and $L_m$ is the length measurement of the measured last. According to the equations described above, the prediction assumes linear scaling of the length and circumference of the last with nominal shoe size. Thus, the internal volume of a shoe and the amount of volume expansion may be predicted based on a last testing of a single shoe size.

To demonstrate the measurements and calculations described above, last testing was performed on embodiments of an adjustable shoe similar to the embodiments shown in FIGS. 18A-20B. Differently sized lasts were tested for fit inside of the shoes, and each tested last had measurements taken in the regions corresponding to them marked measurements shown in FIGS. 21A-21B. Three of the lasts measured have the measurements recorded in Table 1 below. The lasts were tested in a Women's US size 7 shoe. A nominally sized 7 last ("7") was tested, as well as a larger sized last ("7+") and the largest last which fit inside of the shoe ("7++"). Across each last, the sole of the last was held constant to approximate volumetric swelling of the upper regions of the foot. That is, the bottom length, bottom widths, and stick length were held constant across the lasts. As shown in Table 1, girth measurements (i.e., circumferential measurements) around the last in various regions increased from the nominally sized last 7 to the largest last 7++. The girth measurements correspond to circumference measurements following the labeled lines shown in FIG. 21A. It should also be noted that while three last measurements are described here for simplicity, any suitable number of lasts may be used to test the shoe to determine the largest last measurements which an adjustable shoe may accommodate in one or more regions of the shoe.

TABLE 1

Experimental measurements of differently sized lasts being accommodated by a shoe according to exemplary embodiments described herein (e.g., the shoes shown in any of FIGS. 18A-20B). The experimental results demonstrate an ability to expand the shoe volumetrically as measured in various regions of the foot of a wearer.

| Measurement (mm) | 7 | 7+ | 7++ |
|---|---|---|---|
| Stick (S1-S2) | 247 | 247 | 247 |
| Bottom Length (L1-L2) | 247 | 247 | 247 |
| Bottom Width (W1-W2) | 79.9 | 79.9 | 79.9 |
| LBP Heel Width (W3-W4) | 59.5 | 59.5 | 59.5 |
| Ball Girth (G1-G2) | 230 | 234.76 | 239.52 |
| Waist Girth (G3-G4) | 232 | 236.76 | 241.52 |
| Instep Girth (G5-G6) | 239 | 243.76 | 248.52 |
| Toe Spring (T1-T2) | 17 | 17 | 17 |
| Heel Pitch (H1-H2) | 22 | 22 | 22 |
| Toe Thickness (T4-T5) | 25 | 26 | 26.5 |

After the measurements were taken for each of the lasts, the girth measurements were used to compute approximate internal volumes. The calculations were performed using the equations described above, with the assumption the internal volume of the shoe was represented by a cylinder which extends the stick length of the measured last. The computed approximate radii and volumes derived from the ball girth, waist, girth, and instep girth measurements are shown in Table 2 below. In particular, a ball radius, waist radius, and instep radius were derived from the ball girth, waist girth, and instep girth, respectively. From the ball radius, waist radius, and instep radius the approximate cross-sectional area was computed and multiplied by the length of the last to yield a cylindrical volume for each girth measurement, as described previously. Once each volume was calculated, the volume expansion, $\Delta V$, between the nominally sized last 7 and the largest last 7++ was computed. Additionally the expandability coefficient, $\varepsilon$, for each region derived volume was calculated. According to this particular shoe embodiment, the volume expandability was between 8-9% for each measured region. Of course, as discussed previously, other adjustable shoe embodiments may have expandability coefficients greater than, less than, or equal to those computed here, as the present disclosure is not so limited.

TABLE 2

Approximate adjustable shoe radii and volumes calculated based on the measured volumes for volume expandability of a nominal Women's US size 7 shoe based on the measurements taken in Table 1. The volume calculations assume the circumference measurement of the last taken at the ball, waist, and instep approximates the circumference of a circular cross-section of a cylindrical volume which extends the overall length of the shoe (i.e., stick length).

| Size | Ball Radius (mm) | Ball Volume ($cm^2$) | Waist Radius (mm) | Waist Volume ($cm^2$) | Instep Radius (mm) | Instep Volume ($cm^2$) |
|---|---|---|---|---|---|---|
| 7 | 36.6 | 1039.8 | 36.9 | 1057.9 | 38.0 | 1122.7 |
| 7+ | 37.4 | 1083.3 | 37.7 | 1101.8 | 38.8 | 1167.9 |
| 7++ | 38.1 | 1127.6 | 38.4 | 1146.6 | 39.6 | 1214.0 |
| $\Delta V$ (7++ − 7) | 1.5 | 87.9 | 1.5 | 88.6 | 1.5 | 91.2 |
| $\varepsilon$ | | 8.4% | | 8.4% | | 8.1% |

After the radii and volumes of the adjustable shoe were calculated based on each of the girth measurements based on the cylindrical volume assumption, the volumes were normalized for a nominal Women's US shoe size. That is, the computed radius for the nominal last 7 and largest last 7++ were converted into predicted radii for other nominal US shoe sizes based on a linear scaling assumption of the circumferential measurements (i.e., ball girth, waist girth, and instep girth) and overall length between sizes. The predicted nominal volumes and maximum expansion volumes (designated by the "+") are shown for sizes 4 to 15 in Table 3 below. According to the prediction shown in Table 3, the predicted volume expansion scales cubically with the shoe size.

TABLE 3

Predicted volume accommodations for nominal Women's US shoe sizes based on the measurements of the 7-7++ lasts shown in Table 1. By normalizing the volume accommodation measurements and calculations described above for shoe size, the volumetric accommodation of the adjustable shoe may be predicted across a range of shoe sizes. The "+" size marker in the left column indicates a predicted maximum volume accommodation based on the measurements of the 7++ last of Table 1. Of course, the measurements may be normalized and converted for any suitable shoe size, as the present disclosure is not so limited.

| Size | Ball Radius (mm) | Ball Volume ($cm^2$) | Waist Radius (mm) | Waist Volume ($cm^2$) | Instep Radius (mm) | Instep Volume ($cm^2$) |
|---|---|---|---|---|---|---|
| 4 | 20.9 | 194.0 | 21.1 | 197.4 | 21.7 | 209.5 |
| 4+ | 21.8 | 210.4 | 22.0 | 213.9 | 22.6 | 226.5 |
| 5 | 26.1 | 378.9 | 26.4 | 385.5 | 27.2 | 409.2 |
| 5+ | 27.2 | 410.9 | 27.5 | 417.8 | 28.3 | 442.4 |
| 6 | 31.4 | 654.8 | 31.6 | 666.2 | 32.6 | 707.0 |
| 6+ | 32.7 | 710.1 | 32.9 | 722.0 | 33.9 | 764.5 |
| 7 | 36.6 | 1039.8 | 36.9 | 1057.9 | 38.0 | 1122.7 |
| 7+ | 38.1 | 1127.6 | 38.4 | 1146.6 | 39.6 | 1214.0 |
| 8 | 41.8 | 1552.1 | 42.2 | 1579.2 | 43.5 | 1675.9 |
| 8+ | 43.6 | 1683.2 | 43.9 | 1711.5 | 45.2 | 1812.1 |
| 9 | 47.1 | 2209.9 | 47.5 | 2248.5 | 48.9 | 2386.3 |
| 9+ | 49.0 | 2396.6 | 49.4 | 2436.8 | 50.9 | 2580.1 |
| 10 | 52.3 | 3031.4 | 52.7 | 3084.4 | 54.3 | 3273.3 |
| 10+ | 54.5 | 3287.6 | 54.9 | 3342.7 | 56.5 | 3539.3 |
| 11 | 57.5 | 4034.8 | 58.0 | 4105.3 | 59.8 | 4356.8 |
| 11+ | 59.9 | 4375.8 | 60.4 | 4449.2 | 62.2 | 4710.8 |
| 12 | 62.8 | 5238.3 | 63.3 | 5329.8 | 65.2 | 5656.3 |
| 12+ | 65.3 | 5680.9 | 65.9 | 5776.2 | 67.8 | 6115.9 |
| 13 | 68.0 | 6660.1 | 68.6 | 6776.4 | 70.6 | 7191.5 |
| 13+ | 70.8 | 7222.8 | 71.4 | 7343.9 | 73.5 | 7775.8 |
| 14 | 73.2 | 8318.3 | 73.8 | 8463.6 | 76.1 | 8982.0 |
| 14+ | 76.2 | 9021.1 | 76.9 | 9172.4 | 79.1 | 9711.8 |
| 15 | 78.4 | 10231.1 | 79.1 | 10409.8 | 81.5 | 11047.5 |
| 15+ | 81.7 | 11095.6 | 82.4 | 11281.7 | 84.8 | 11945.1 |

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. An adjustable shoe comprising:

a sole including a toe, a heel, a lower surface, and an outer periphery;

an adjustable upper secured to at least a portion of the outer periphery, the adjustable upper comprising:

a toe panel constructed and arranged to expand vertically and longitudinally relative to the sole, wherein the toe panel is secured to the toe of the sole and encloses the toe, a heel panel constructed and arranged to expand laterally and longitudinally relative to the sole, wherein the heel panel is secured to the heel of the sole, a first side panel secured to at least a portion of the outer periphery, and a second side panel secured to at least a portion of the outer periphery;

a first elastic lace constructed and arranged to connect the toe panel to the first side panel and the second side panel; and a stretch liner secured to at least a portion of the outer periphery and attached to the first side panel and second side panel, wherein the first side panel and second side panel are independent from the toe panel, and wherein the toe panel, heel panel, first side panel, and second side panel are independently expandable relative to one another.

2. The adjustable shoe of claim 1, wherein the stretch liner and heel panel are independently expandable relative to one another.

3. The adjustable shoe of claim 1, wherein the stretch liner is secured to the heel panel, wherein the stretch liner and heel panel expand together.

4. The adjustable shoe of claim 1, further comprising a second elastic lace constructed and arranged to connect the heel panel to the first side panel and the second side panel.

5. The adjustable shoe of claim 1, wherein the sole includes a recess and a removable footbed, wherein an uppermost portion of the outer periphery is aligned with an uppermost portion of the removable footbed.

6. The adjustable shoe of claim 1, wherein the adjustable upper and the stretch liner enclose a footbed of the sole.

7. The adjustable shoe of claim 1, wherein the stretch liner includes a tongue.

8. The adjustable shoe of claim 1, wherein the stretch liner is not connected to the toe panel.

9. The adjustable shoe of claim 1, wherein the stretch liner is directly attached to the first side panel and the second side panel.

10. An adjustable shoe comprising:

a sole including a lower surface and an outer periphery;

an adjustable upper secured to at least a portion of the outer periphery, wherein the adjustable upper is expandable at least two directions selected from the group of vertical, lateral, and longitudinal, wherein the adjustable upper includes:

a toe panel secured to a first portion of the outer periphery, and at least one side panel secured to a second portion of the outer periphery, wherein the at least one side panel is independent from the toe panel, and wherein the first portion and second portion of the outer periphery are separate from one another; and a stretch liner secured to at least a portion of the outer periphery and attached to the at least one side panel, wherein the stretch liner includes a tongue, wherein the adjustable upper has a ball region expandability coefficient between 8% and 12%.

11. The adjustable shoe of claim 10, wherein the adjustable upper has a waist region expandability coefficient between 8% and 12%.

12. The adjustable shoe of claim 10, wherein the adjustable upper has an instep region expandability coefficient between 8% and 12%.

13. The adjustable shoe of claim 10, wherein the sole includes a recess and a removable footbed, wherein an uppermost portion of the outer periphery is aligned with an uppermost portion of the removable footbed.

14. The adjustable shoe of claim 10, wherein the adjustable upper and the stretch liner enclose a footbed of the sole.

15. The adjustable shoe of claim 10, wherein the stretch liner is not connected to the toe panel.

16. The adjustable shoe of claim 10, wherein the stretch liner is directly attached to the at least one side panel.

17. An adjustable shoe comprising:

a sole including a toe, a heel, a lower surface, and an outer periphery;

an adjustable upper secured to at least a portion of the outer periphery, the adjustable upper comprising:

a toe panel constructed and arranged to expand vertically and longitudinally relative to the sole, wherein the toe panel is secured to the toe of the sole and encloses the toe, a heel panel constructed and arranged to expand laterally and longitudinally relative to the sole, wherein the heel panel is secured to the heel of the sole, a first side panel secured to at least a portion of the outer periphery, and a second side panel secured to at least a portion of the outer periphery; and a stretch liner secured to at least a portion of the outer periphery and attached to the first side panel and second side panel, wherein the stretch liner includes a tongue, wherein the first side panel and second side panel are independent from the toe panel, and wherein the toe panel, heel panel, first side panel, and second side panel are independently expandable relative to one another.

18. The adjustable shoe of claim 17, wherein the stretch liner and heel panel are independently expandable relative to one another.

19. The adjustable shoe of claim 17, wherein the sole includes a recess and a removable footbed, wherein an uppermost portion of the outer periphery is aligned with an uppermost portion of the removable footbed.

20. The adjustable shoe of claim 17, wherein the stretch liner is not connected to the toe panel.

* * * * *